United States Patent [19]

Ganz

[11] 3,940,907

[45] Mar. 2, 1976

[54] BOTTLE PACKAGING MACHINE

[75] Inventor: Robert H. Ganz, Saddle River, N.J.

[73] Assignee: Federal Paper Board Company, Inc., Montvale, N.J.

[22] Filed: May 15, 1974

[21] Appl. No.: 470,036

[52] U.S. Cl. ..... 53/48; 53/183; 53/381 R

[51] Int. Cl.[2] ..... B65B 21/22

[58] Field of Search ..... 53/381 R, 48, 183, 196; 90/39, 44, 53 R

[56] References Cited

UNITED STATES PATENTS

| | | | |
|---|---|---|---|
| 3,061,986 | 11/1962 | Paps | 53/48 |
| 3,108,414 | 10/1963 | Schleicher | 53/48 |
| 3,182,431 | 5/1965 | Ganz | 53/48 X |
| 3,187,479 | 6/1965 | Ganz | 53/48 X |
| 3,254,470 | 6/1966 | Cuvie, Jr. | 53/48 |
| 3,557,521 | 1/1971 | Pierce, Jr. | 53/48 |
| 3,698,151 | 10/1972 | Arneson | 53/48 |
| 3,751,872 | 8/1973 | Helms | 53/48 X |

*Primary Examiner*—Donald R. Schran
*Assistant Examiner*—Leon Gilden
*Attorney, Agent, or Firm*—Guy A. Greenawalt

[57] ABSTRACT

An apparatus for automatically opening and loading collapsed bottle carriers or cartons, which are formed of paperboard or similar foldable sheet material and which are adapted to be loaded through an open bottom after being set up into tubular condition, which apparatus comprises conveyor mechanism for advancing successive collapsed cartons and associated plow members for opening the same into tubular shape, with the cartons assuming a vertical position above a bottle carrying and grouping conveyor which delivers successive groups of the bottles to an assembly area where the cartons are lowered onto the bottle groups and thereafter advanced through mechanism which closes top and bottom wall forming panels and engages locking and latching members formed in overlapping margins of the panels so as to complete the packaging operation.

23 Claims, 34 Drawing Figures

TO FIG. 1B
TO FIG. 2B

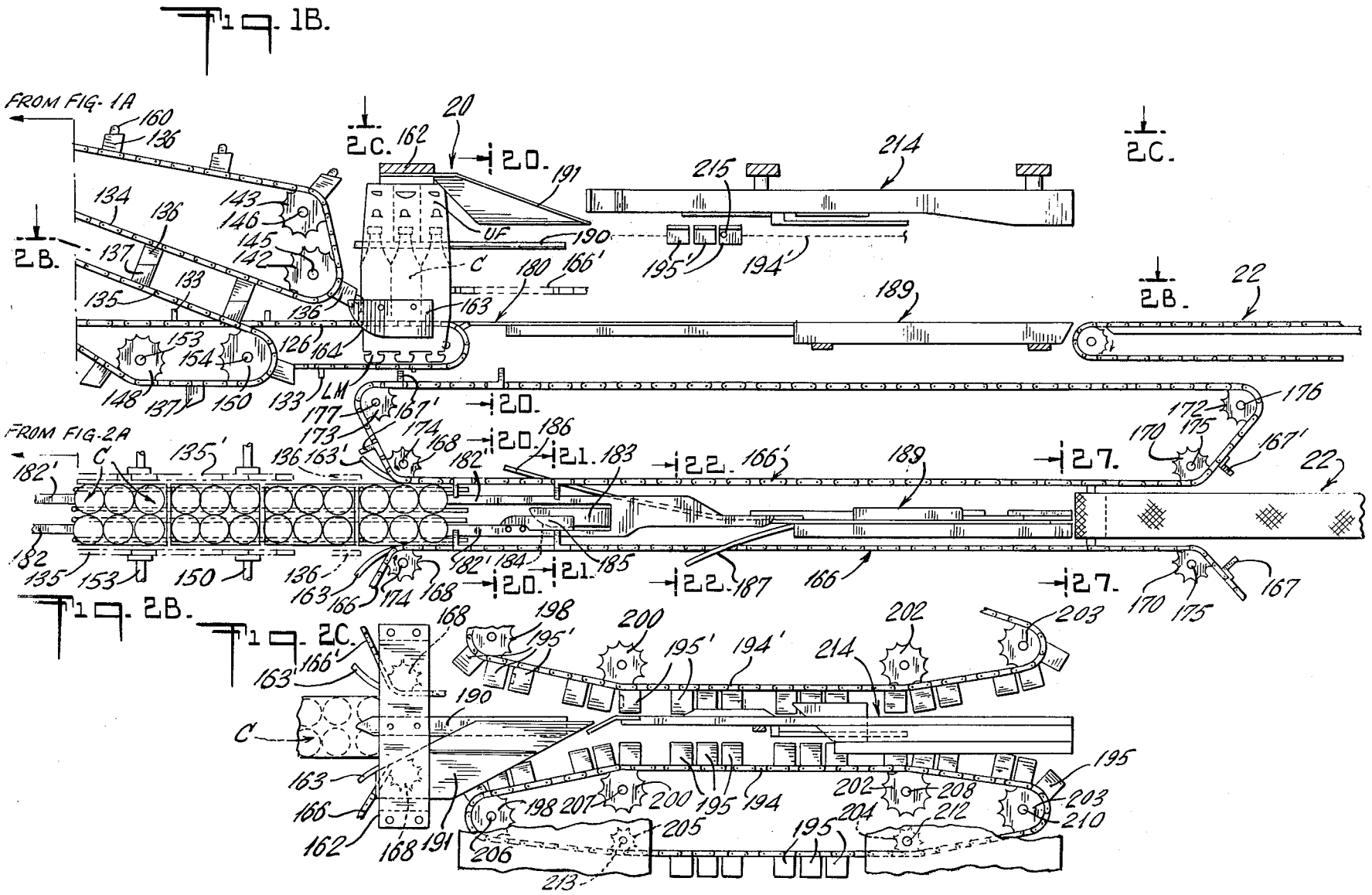
FIG. 1B.
FROM FIG. 1A
FROM FIG. 2A
2B.
2C.
2D.
2E.
2F.
2G.
2H.
2I.
2J.
2K.
2L.
2M.
2N.
2O.
2P.
2Q.
2R.
2S.
2T.
2U.
2V.
2W.
2X.
2Y.
2Z.
2AA.
2BB.
2CC.
2DD.
2EE.
2FF.
2GG.
2HH.
2II.
2JJ.
2KK.
2LL.
2MM.
2NN.
2OO.
2PP.
2QQ.
2RR.
2SS.
2TT.
2UU.
2VV.
2WW.
2XX.
2YY.
2ZZ.
2AAA.
2BBB.
2CCC.
2DDD.
2EEE.
2FFF.
2GGG.
2HHH.
2III.
2JJJ.
2KKK.
2LLL.
2MMM.
2NNN.
2OOO.
2PPP.
2QQQ.
2RRR.
2SSS.
2TTT.
2UUU.
2VVV.
2WWW.
2XXX.
2YYY.
2ZZZ.
2AAAA.
2BBBB.
2CCCC.
2DDDD.
2EEEE.
2FFFF.
2GGGG.
2HHHH.
2IIII.
2JJJJ.
2KKKK.
2LLLL.
2MMMM.
2NNNN.
2OOOO.
2PPPP.
2QQQQ.
2RRRR.
2SSSS.
2TTTT.
2UUUU.
2VVVV.
2WWWW.
2XXXX.
2YYYY.
2ZZZZ.
2AAAAA.
2BBBBB.
2CCCCC.
2DDDDD.
2EEEEE.
2FFFFF.
2GGGGG.
2HHHHH.
2IIIII.
2JJJJJ.
2KKKKK.
2LLLLL.
2MMMMM.
2NNNNN.
2OOOOO.
2PPPPP.
2QQQQQ.
2RRRRR.
2SSSSS.
2TTTTT.
2UUUUU.
2VVVVV.
2WWWWW.
2XXXXX.
2YYYYY.
2ZZZZZ.
2AAAAAA.
2BBBBBB.
2CCCCCC.
2DDDDDD.
2EEEEEE.
2FFFFFF.
2GGGGGG.
2HHHHHH.
2IIIIII.
2JJJJJJ.
2KKKKKK.
2LLLLLL.
2MMMMMM.
2NNNNNN.
2OOOOOO.
2PPPPPP.
2QQQQQQ.
2RRRRRR.
2SSSSSS.
2TTTTTT.
2UUUUUU.
2VVVVVV.
2WWWWWW.
2XXXXXX.
2YYYYYY.
2ZZZZZZ.
2AAAAAAA.
2BBBBBBB.
2CCCCCCC.
2DDDDDDD.
2EEEEEEE.
2FFFFFFF.
2GGGGGGG.
2HHHHHHH.
2IIIIIIII.
2JJJJJJJ.
2KKKKKKK.
2LLLLLLL.
2MMMMMMM.
2NNNNNNN.
2OOOOOOO.
2PPPPPPP.
2QQQQQQQ.
2RRRRRRR.
2SSSSSSS.
2TTTTTTT.
2UUUUUUU.
2VVVVVVV.
2WWWWWWW.
2XXXXXXX.
2YYYYYYY.
2ZZZZZZZ.
2AAAAAAAA.
2BBBBBBBB.
2CCCCCCCC.
2DDDDDDDD.
2EEEEEEEE.
2FFFFFFFF.
2GGGGGGGG.
2HHHHHHHH.
2IIIIIIIII.
2JJJJJJJJ.
2KKKKKKKK.
2LLLLLLLL.
2MMMMMMMM.
2NNNNNNNN.
2OOOOOOOO.
2PPPPPPPP.
2QQQQQQQQ.
2RRRRRRRR.
2SSSSSSSS.
2TTTTTTTT.
2UUUUUUUU.
2VVVVVVVV.
2WWWWWWWW.
2XXXXXXXX.
2YYYYYYYY.
2ZZZZZZZZ.
2AAAAAAAAA.
2BBBBBBBBB.
2CCCCCCCCC.
2DDDDDDDDD.
2EEEEEEEEE.
2FFFFFFFFF.
2GGGGGGGGG.
2HHHHHHHHH.
2IIIIIIIIII.
2JJJJJJJJJ.
2KKKKKKKKK.
2LLLLLLLLL.
2MMMMMMMMM.
2NNNNNNNNN.
2OOOOOOOOO.
2PPPPPPPPP.
2QQQQQQQQQ.
2RRRRRRRRR.
2SSSSSSSSS.
2TTTTTTTTT.
2UUUUUUUUU.
2VVVVVVVVV.
2WWWWWWWWW.
2XXXXXXXXX.
2YYYYYYYYY.
2ZZZZZZZZZ.
2AAAAAAAAAA.
2BBBBBBBBBB.
2CCCCCCCCCC.
2DDDDDDDDDD.
2EEEEEEEEEE.
2FFFFFFFFFF.
2GGGGGGGGGG.
2HHHHHHHHHH.
2IIIIIIIIIII.
2JJJJJJJJJJ.
2KKKKKKKKKK.
2LLLLLLLLLL.
2MMMMMMMMMM.
2NNNNNNNNNN.
2OOOOOOOOOO.
2PPPPPPPPPP.
2QQQQQQQQQQ.
2RRRRRRRRRR.
2SSSSSSSSSS.
2TTTTTTTTTT.
2UUUUUUUUUU.
2VVVVVVVVVV.
2WWWWWWWWWW.
2XXXXXXXXXX.
2YYYYYYYYYY.
2ZZZZZZZZZZ.
2AAAAAAAAAAA.
2BBBBBBBBBBB.
2CCCCCCCCCCC.
2DDDDDDDDDDD.
2EEEEEEEEEEE.
2FFFFFFFFFFF.
2GGGGGGGGGGG.
2HHHHHHHHHHH.
2IIIIIIIIIIII.
2JJJJJJJJJJJ.
2KKKKKKKKKKK.
2LLLLLLLLLLL.
2MMMMMMMMMMM.
2NNNNNNNNNNN.
2OOOOOOOOOOO.
2PPPPPPPPPPP.
2QQQQQQQQQQQ.
2RRRRRRRRRRR.
2SSSSSSSSSSS.
2TTTTTTTTTTT.
2UUUUUUUUUUU.
2VVVVVVVVVVV.
2WWWWWWWWWWW.
2XXXXXXXXXXX.
2YYYYYYYYYYY.
2ZZZZZZZZZZZ.
2AAAAAAAAAAAA.
2BBBBBBBBBBBB.
2CCCCCCCCCCCC.
2DDDDDDDDDDDD.
2EEEEEEEEEEEE.
2FFFFFFFFFFFF.
2GGGGGGGGGGGG.
2HHHHHHHHHHHH.
2IIIIIIIIIIIII.
2JJJJJJJJJJJJ.
2KKKKKKKKKKKK.
2LLLLLLLLLLLL.
2MMMMMMMMMMMM.
2NNNNNNNNNNNN.
2OOOOOOOOOOOO.
2PPPPPPPPPPPP.
2QQQQQQQQQQQQ.
2RRRRRRRRRRRR.
2SSSSSSSSSSSS.
2TTTTTTTTTTTT.
2UUUUUUUUUUUU.
2VVVVVVVVVVVV.
2WWWWWWWWWWWW.
2XXXXXXXXXXXX.
2YYYYYYYYYYYY.
2ZZZZZZZZZZZZ.
2AAAAAAAAAAAAA.
2BBBBBBBBBBBBB.
2CCCCCCCCCCCCC.
2DDDDDDDDDDDDD.
2EEEEEEEEEEEEE.
2FFFFFFFFFFFFF.
2GGGGGGGGGGGGG.
2HHHHHHHHHHHHH.
2IIIIIIIIIIIIII.
2JJJJJJJJJJJJJ.
2KKKKKKKKKKKKK.
2LLLLLLLLLLLLL.
2MMMMMMMMMMMMM.
2NNNNNNNNNNNNN.
2OOOOOOOOOOOOO.
2PPPPPPPPPPPPP.
2QQQQQQQQQQQQQ.
2RRRRRRRRRRRRR.
2SSSSSSSSSSSSS.
2TTTTTTTTTTTTT.
2UUUUUUUUUUUUU.
2VVVVVVVVVVVVV.
2WWWWWWWWWWWWW.
2XXXXXXXXXXXXX.
2YYYYYYYYYYYYY.
2ZZZZZZZZZZZZZ.
2AAAAAAAAAAAAAA.
2BBBBBBBBBBBBBB.
2CCCCCCCCCCCCCC.
2DDDDDDDDDDDDDD.
2EEEEEEEEEEEEEE.
2FFFFFFFFFFFFFF.
2GGGGGGGGGGGGGG.
2HHHHHHHHHHHHHH.
2IIIIIIIIIIIIIII.
2JJJJJJJJJJJJJJ.
2KKKKKKKKKKKKKK.
2LLLLLLLLLLLLLL.
2MMMMMMMMMMMMMM.
2NNNNNNNNNNNNNN.
2OOOOOOOOOOOOOO.
2PPPPPPPPPPPPPP.
2QQQQQQQQQQQQQQ.
2RRRRRRRRRRRRRR.
2SSSSSSSSSSSSSS.
2TTTTTTTTTTTTTT.
2UUUUUUUUUUUUUU.
2VVVVVVVVVVVVVV.
2WWWWWWWWWWWWWW.
2XXXXXXXXXXXXXX.
2YYYYYYYYYYYYYY.
2ZZZZZZZZZZZZZZ.
2AAAAAAAAAAAAAAA.
2BBBBBBBBBBBBBBB.
2CCCCCCCCCCCCCCC.
2DDDDDDDDDDDDDDD.
2EEEEEEEEEEEEEEE.
2FFFFFFFFFFFFFFF.
2GGGGGGGGGGGGGGG.
2HHHHHHHHHHHHHHH.
2IIIIIIIIIIIIIIII.
2JJJJJJJJJJJJJJJ.
2KKKKKKKKKKKKKKK.
2LLLLLLLLLLLLLLL.
2MMMMMMMMMMMMMMM.
2NNNNNNNNNNNNNNN.
2OOOOOOOOOOOOOOO.
2PPPPPPPPPPPPPPP.
2QQQQQQQQQQQQQQQ.
2RRRRRRRRRRRRRRR.
2SSSSSSSSSSSSSSS.
2TTTTTTTTTTTTTTT.
2UUUUUUUUUUUUUUU.
2VVVVVVVVVVVVVVV.
2WWWWWWWWWWWWWWW.
2XXXXXXXXXXXXXXX.
2YYYYYYYYYYYYYYY.
2ZZZZZZZZZZZZZZZ.
2AAAAAAAAAAAAAAAA.
2BBBBBBBBBBBBBBBB.
2CCCCCCCCCCCCCCCC.
2DDDDDDDDDDDDDDDD.
2EEEEEEEEEEEEEEEE.
2FFFFFFFFFFFFFFFF.
2GGGGGGGGGGGGGGGG.
2HHHHHHHHHHHHHHHH.
2IIIIIIIIIIIIIIIII.
2JJJJJJJJJJJJJJJJ.
2KKKKKKKKKKKKKKKK.
2LLLLLLLLLLLLLLLL.
2MMMMMMMMMMMMMMMM.
2NNNNNNNNNNNNNNNN.
2OOOOOOOOOOOOOOOO.
2PPPPPPPPPPPPPPPP.
2QQQQQQQQQQQQQQQQ.
2RRRRRRRRRRRRRRRR.
2SSSSSSSSSSSSSSSS.
2TTTTTTTTTTTTTTTT.
2UUUUUUUUUUUUUUUU.
2VVVVVVVVVVVVVVVV.
2WWWWWWWWWWWWWWWW.
2XXXXXXXXXXXXXXXX.
2YYYYYYYYYYYYYYYY.
2ZZZZZZZZZZZZZZZZ.
2AAAAAAAAAAAAAAAAA.
2BBBBBBBBBBBBBBBBB.
2CCCCCCCCCCCCCCCCC.
2DDDDDDDDDDDDDDDDD.
2EEEEEEEEEEEEEEEEE.
2FFFFFFFFFFFFFFFFF.
2GGGGGGGGGGGGGGGGG.
2HHHHHHHHHHHHHHHHH.
2IIIIIIIIIIIIIIIIII.
2JJJJJJJJJJJJJJJJJ.
2KKKKKKKKKKKKKKKKK.
2LLLLLLLLLLLLLLLLL.
2MMMMMMMMMMMMMMMMM.
2NNNNNNNNNNNNNNNNN.
2OOOOOOOOOOOOOOOOO.
2PPPPPPPPPPPPPPPPP.
2QQQQQQQQQQQQQQQQQ.
2RRRRRRRRRRRRRRRRR.
2SSSSSSSSSSSSSSSSS.
2TTTTTTTTTTTTTTTTT.
2UUUUUUUUUUUUUUUUU.
2VVVVVVVVVVVVVVVVV.
2WWWWWWWWWWWWWWWWW.
2XXXXXXXXXXXXXXXXX.
2YYYYYYYYYYYYYYYYY.
2ZZZZZZZZZZZZZZZZZ.
2AAAAAAAAAAAAAAAAAA.
2BBBBBBBBBBBBBBBBBB.
2CCCCCCCCCCCCCCCCCC.
2DDDDDDDDDDDDDDDDDD.
2EEEEEEEEEEEEEEEEEE.
2FFFFFFFFFFFFFFFFFF.
2GGGGGGGGGGGGGGGGGG.
2HHHHHHHHHHHHHHHHHH.
2IIIIIIIIIIIIIIIIIII.
2JJJJJJJJJJJJJJJJJJ.
2KKKKKKKKKKKKKKKKKK.
2LLLLLLLLLLLLLLLLLL.
2MMMMMMMMMMMMMMMMMM.
2NNNNNNNNNNNNNNNNNN.
2OOOOOOOOOOOOOOOOOO.
2PPPPPPPPPPPPPPPPPP.
2QQQQQQQQQQQQQQQQQQ.
2RRRRRRRRRRRRRRRRRR.
2SSSSSSSSSSSSSSSSSS.
2TTTTTTTTTTTTTTTTTT.
2UUUUUUUUUUUUUUUUUU.
2VVVVVVVVVVVVVVVVVV.
2WWWWWWWWWWWWWWWWWW.
2XXXXXXXXXXXXXXXXXX.
2YYYYYYYYYYYYYYYYYY.
2ZZZZZZZZZZZZZZZZZZ.
2AAAAAAAAAAAAAAAAAAA.
2BBBBBBBBBBBBBBBBBBB.
2CCCCCCCCCCCCCCCCCCC.
2DDDDDDDDDDDDDDDDDDD.
2EEEEEEEEEEEEEEEEEEE.
2FFFFFFFFFFFFFFFFFFF.
2GGGGGGGGGGGGGGGGGGG.
2HHHHHHHHHHHHHHHHHHH.
2IIIIIIIIIIIIIIIIIIII.
2JJJJJJJJJJJJJJJJJJJ.
2KKKKKKKKKKKKKKKKKKK.
2LLLLLLLLLLLLLLLLLLL.
2MMMMMMMMMMMMMMMMMMM.
2NNNNNNNNNNNNNNNNNNN.
2OOOOOOOOOOOOOOOOOOO.
2PPPPPPPPPPPPPPPPPPP.
2QQQQQQQQQQQQQQQQQQQ.
2RRRRRRRRRRRRRRRRRRR.
2SSSSSSSSSSSSSSSSSSS.
2TTTTTTTTTTTTTTTTTTT.
2UUUUUUUUUUUUUUUUUUU.
2VVVVVVVVVVVVVVVVVVV.
2WWWWWWWWWWWWWWWWWWW.
2XXXXXXXXXXXXXXXXXXX.
2YYYYYYYYYYYYYYYYYYY.
2Z

TO FIG. 9.

FROM FIG. 4

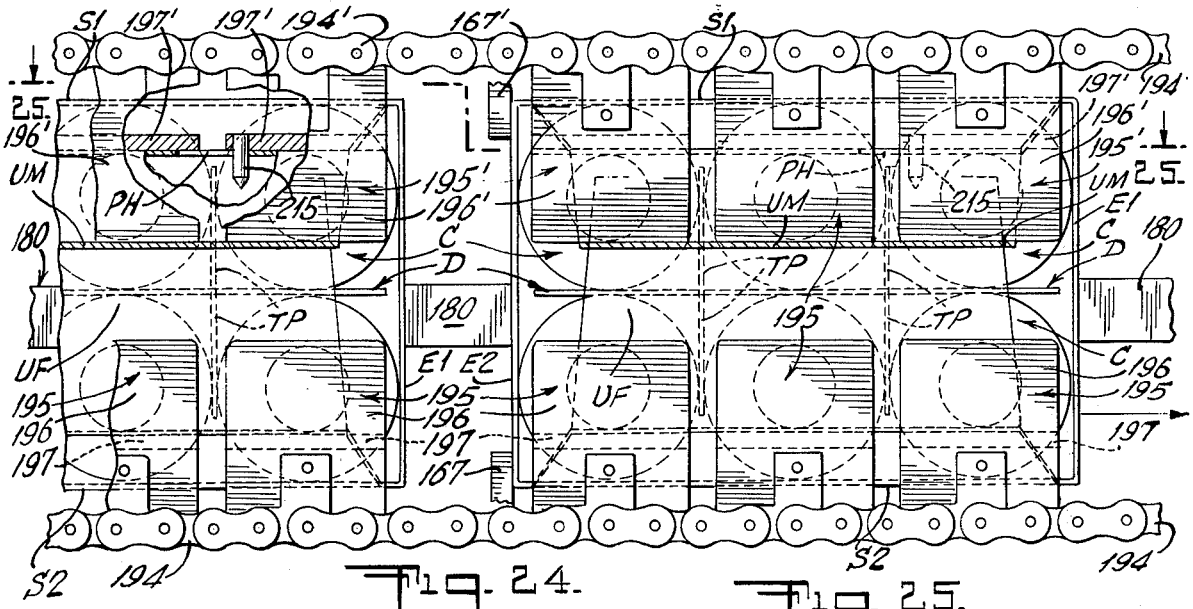
Fig. 24.
Fig. 25.
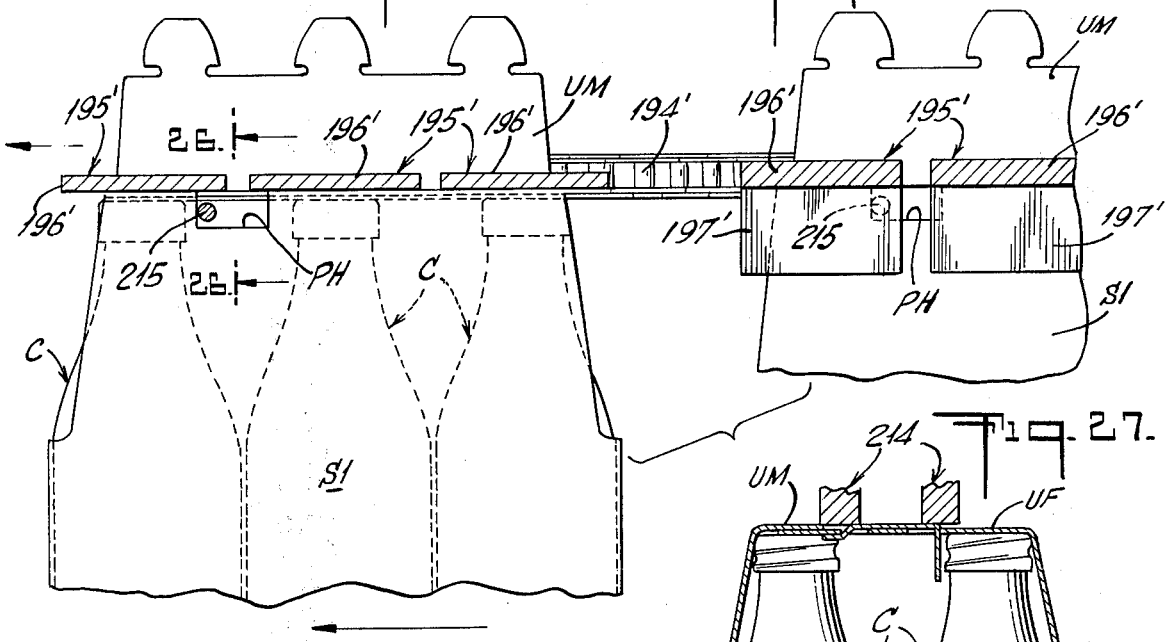
Fig. 27.
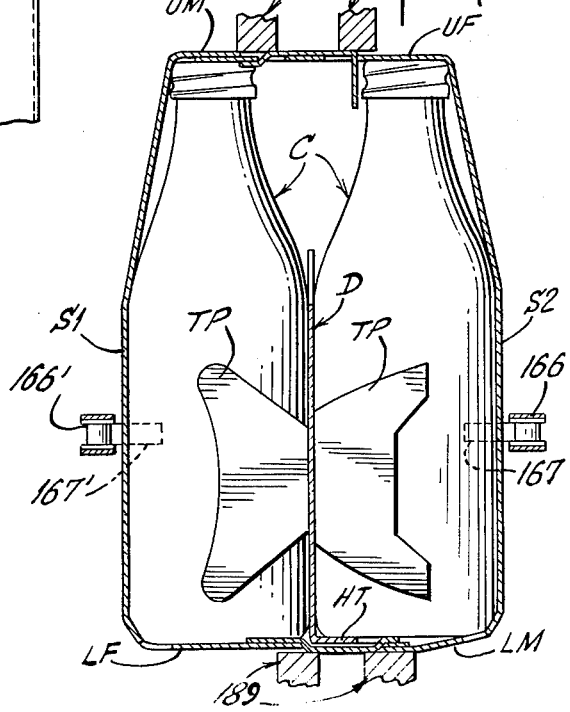
Fig. 26.
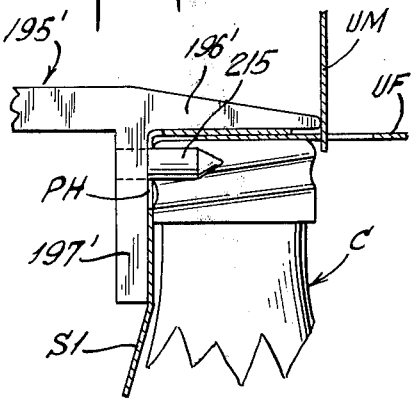

BOTTLE PACKAGING MACHINE

This invention relates to packaging machinery or apparatus and is more particularly concerned with improvements in apparatus for opening collapsed or flattened carriers or cartons for beverage bottles, or similar articles, and filling the same with a predetermined number of bottles wherein the carriers are of the type which are initially formed as a collapsed tube with top and bottom wall forming panels extended in the plane of the side wall forming panels and having overlapping margins witth interengageable locking and latching elements herein.

In the marketing of products such as bottled and canned beverages and the like, many different packaging arrangements have been employed. Generally, each new packaging design has resulted in the development of new machinery for handling the packaging operations. Two general types of packages have proven most acceptable to the beverage bottling and canning industry, both of which are adapted to contain a multiplicity of the product elements, usually six, eight or twelve bottles or cans. One form of package, used most often for canned beverages, is formed by wrapping an elongate rectangular blank, which is especially cut and scored, about an assembly of cans or bottles with its end secured so as to tightly enclose the assembly. Another type of package which is used for bottled beverages employs a carton which is in the form of a cellular basket with an open top and having a collapsed cell-forming partition structure which is opened up to receive the bottles when the initially collapsed carrier is set up. In loading this type carrier the bottles are dropped into the cells through the open top of the carrier. This involves considerable handling of the bottles which is undesirable. More recently there has been developed a package which employs a carton having some of the characteristics of both the basket type and the wraparound type and which is fabricated in collapsed or flattened condition with bottom wall forming panels initially extended in the plane of the side walls and enabling the container to be opened into tubular form and dropped over an assembly of bottles after which the bottom wall panels, and in some designs also the top wall panels, are folded to closed position and connected by interengaging locking and latching elements. A carton design of the latter type is disclosed in the application of Edwin A. Arneson and Guelfo A. Manizza, Ser. No. 368,825, filed June 11, 1973. It is a general object of the present invention to provide a machine which will open up a carton or carrier of this general type, drop it over an assembly of bottles, close and latch the panels forming the top and bottom wall of the package, which machine will operate efficiently at a relatively high rate of speed so as to be adapted for use in high speed beverage bottling and canning lines.

It is a more specific object of the invention to provide an apparatus for automatically opening, or setting up, collapsed bottle carriers or cartons and filling the same, the cartons being of the type which are adapted to be opened, and to be filled or loaded by depositing them on groups or assemblies of bottles which are advancing on a conveyor in a bottling line or the like, and thereafter closing the bottoms by folding and latching bottom wall forming panels.

It is another object of the invention to provide a machine for opening up collapsed bottle carriers or cartons which are of the type which are initially formed in collapsed tubular condition and with bottom wall forming panels extending in the plane of the side wall panels wherein the machine includes an entrance conveyor having a top run onto which successive collapsed cartons are fed and advanced to an opening station where they are each swung to an upright position and simultaneously opened into tubular condition for deposit from the top into an assembly of bottles carried on a conveyor beneath the carton supporting and feeding conveyor.

It is another object of the invention to provide an apparatus for opening up collapsed bottle packaging cartons which are adapted to be loaded through the bottom wherein the apparatus comprises a horizontally disposed conveyor run on which the collapsed cartons are advanced and opened by means of associated mechanism for turning a bottom wall forming panel into a vertical plane and thereafter swinging the remainder of the carton upwardly while opening it into squared up condition so as to enable it to be advanced to a station or area where it is aligned with and dropped down over an assembly of bottles advancing on a feeding conveyor traveling in a path beneath the carton conveyor.

It is another object of the invention to provide an apparatus for opening up bottle packaging cartons which are initially formed in collapsed tubular condition wherein the apparatus comprises a horizontally disposed conveyor run on which the cartons are advanced and associated mechanism for confining in a predetermined path one of a pair of bottom wall forming panels while turning the carton about the hinge connection of the confined panel with the side wall, into an upright position, and simultaneously squaring up the carton into tubular form, the apparatus including also mechanism enabling successive cartons to be deposited on an assembly of bottles after which the assembly is advanced through mechanism for folding top and bottom wall forming panels into closed position and for latching the same.

These and other objects of the invention will be apparent from a consideration of the carrier or carton opening and loading apparatus which is shown by way of illustration in the accompanying drawings wherein:

FIGS. 1A and 1B constitute a side elevation of a machine embodying the principle features of the invention, the views being in part schematic and having parts thereof omitted or broken away;

FIGS. 2A and 2B constitute a view of the machine taken on a horizontal plane, with portions of the machine omitted and other portions broken away, FIG. 2A being a plan view and FIG. 2B being taken on the plane indicated by the lines 2B—2B on FIG. 1B;

FIG. 2C is a plan view taken on the horizontal plane indicated at 2C—2C on FIG. 1B with portions broken away;

FIG. 24 is a fragmentary view taken on the horizontal plane indicated by the lines 24—24 on FIG. 22, with portions broken away;

FIG. 25 is a fragmentary vertical section taken on the line 25—25 of FIG. 24;

FIG. 26 is a fragmentary cross sectional view taken on the line 26—26 of FIG. 25, to an enlarged scale;

FIG. 27 is a cross sectional view, taken on the line 27—27 of FIG. 2B, the view being to an enlarged scale and showing a cross section of the completed package;

Figure 28:
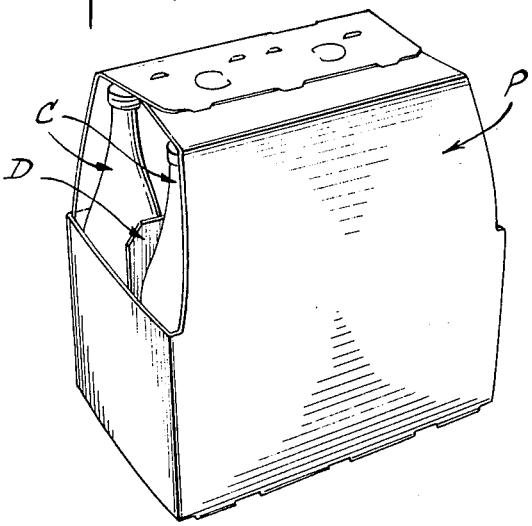
FIG. 28 is a perspective view showing the completed package which is adapted to be formed on the present machine.
Figure 29:
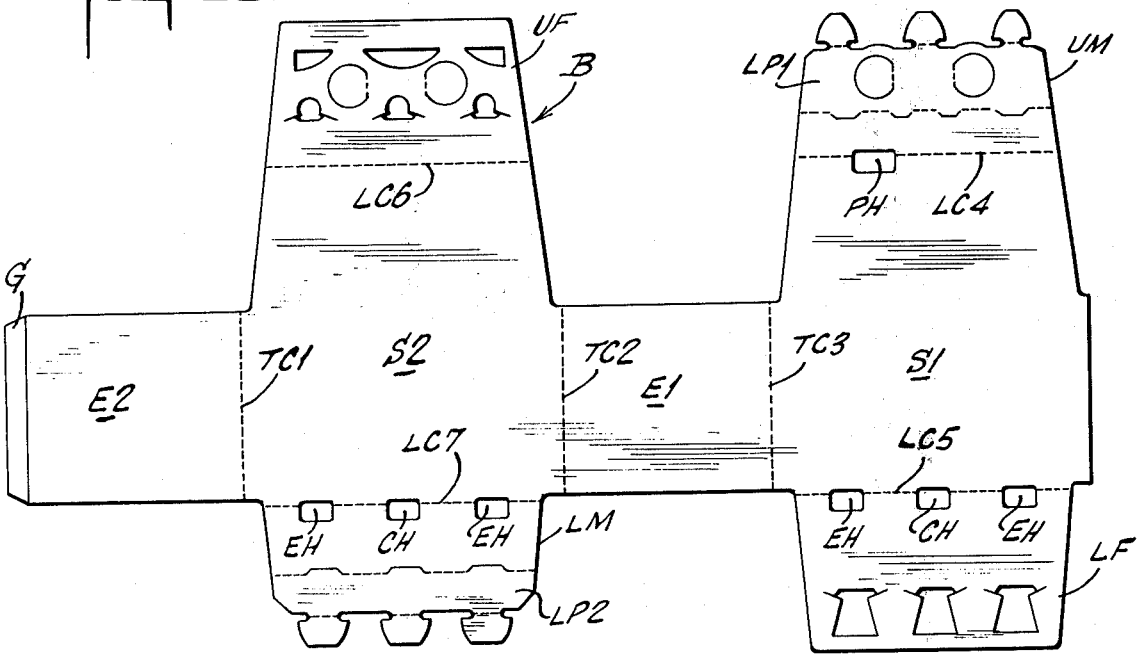
FIG. 29 is a plan view of the blank which is cut and scored to provide the carton in the package of FIG. 28.

Referring to FIG. 28, there is illustrated a package P which is adapted to be formed on the present machine by enclosing a group or assembly of beverage bottles or other product elements of similar character in a carton or carrier which is fabricated from a blank B of paperboard or other suitable package forming sheet material, cut and scored as shown in FIG. 29. While the blank B is illustrated as specially designed for use in the present machine, it has the basic construction shown in application Ser. No. 368,825.

The blank is divided by transverse score lines TC1, TC2 and TC3, which are spaced lengthwise of the blank, into side wall forming panel sections S1 and S2 and end wall forming panels E1 and E2. The side wall panel section S1 has lateral extensions divided therefrom by transversely spaced, longitudinal crease lines LC4 and LC5 which extensions constitute an upper, top wall forming male panel UM, and a lower, bottom wall forming, female panel LF. The side wall forming panel section S2 has lateral extensions of a similar character which are divided therefrom by transversely spaced, longitudinal crease lines LC6 and LC7, which extension panels constitute upper or top wall forming female panel UF and lower, bottom wall forming male panel LM. The upper male panel UM includes a latching panel LP1 and lower male panel LM includes a corresponding latching panel LP2. The co-operating locking apertures for the locking and latching fingers and tabs are provided in the panels LF and UF on the other side of the blank which are aligned transversely therewith. A series of spaced heel holes for the bottles are provided, at one side of the blank, along each of the longitudinal crease lines LC5 and LC7 which are designed CH for the center hole and EH for each of the end holes. Along the opposite side of the blank, the side wall panel section S1 has a relatively small, elongated, rectangular hole or aperture PH cut therein at the top edge forming crease line LC4, for co-operation with a conveyor carried pin or lug, in squaring up the carton, as hereinafter described. Except for the hole PH, the blank B is cut and scored according to the description in Ser. No. 368,825.

Figures 1, 1A, 2A, 3, 4, 5, 6, 7, 8, 9, 10, 11, 12, 13, 14:
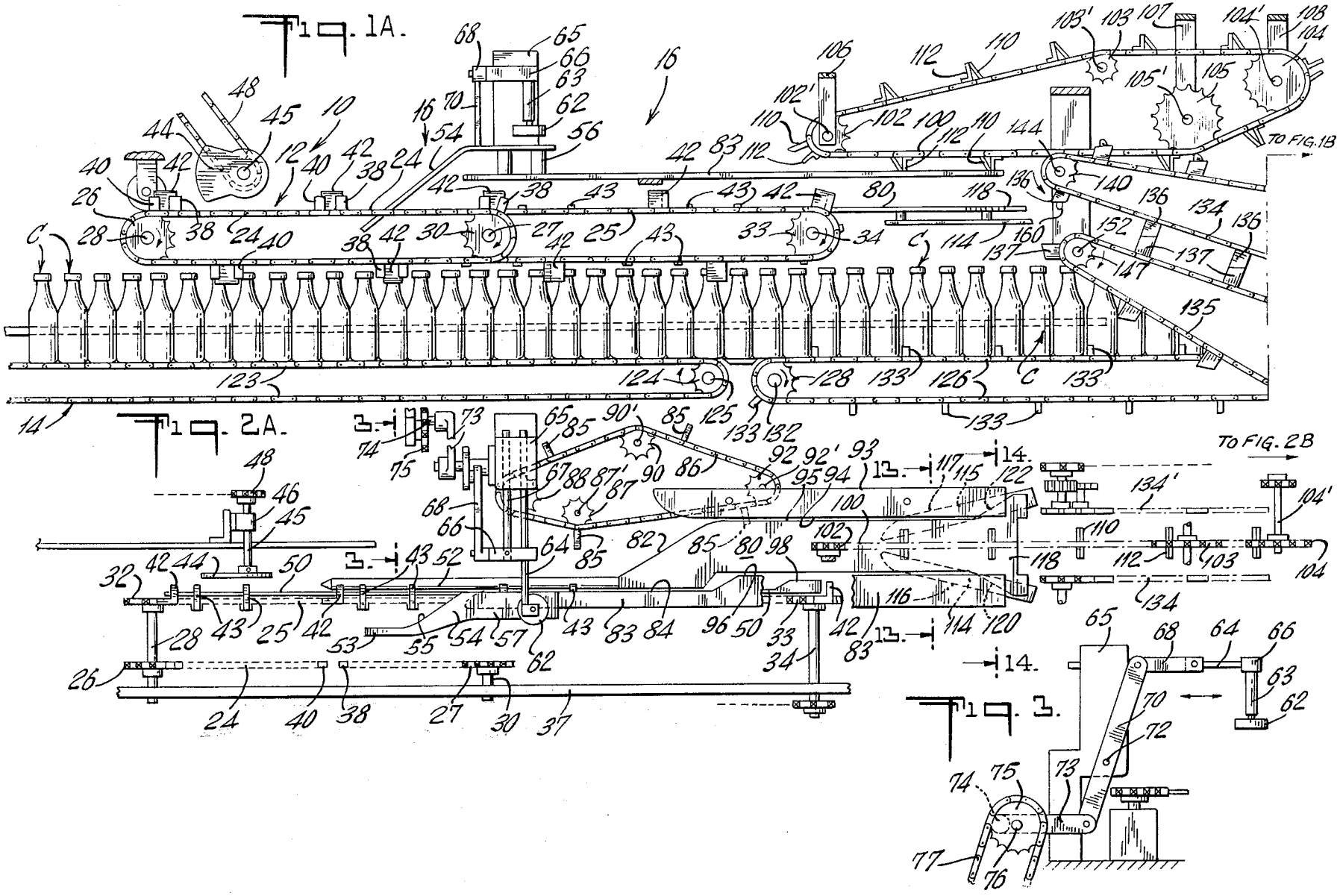
FIG. 3 is a fragmentary cross sectional view, taken on the line 3—3 of FIG. 2A.
FIG. 4 is a partial plan view at the entrance end of the machine, the view being to a larger scale and showing the arrangement of the collapsed cartons on the carton infeed section of the machine.
FIG. 5 is a fragmentary cross sectional view taken on the line 5—5 on FIG. 4.
FIG. 6 is a fragmentary cross sectional view taken on the line 6—6 of FIG. 4.
FIG. 7 is a fragmentary cross sectional view taken on the line 7—7 of FIG. 4.
FIG. 8 is a fragmentary cross sectional view taken on the line 8—8 of FIG. 4.
FIG. 9 is a fragmentary plan view, to an enlarged scale, and with portions broken away, or omitted, the view showing the progress of the carton immediately following the opening operation and constituting a continuation of the view shown in FIG. 4.
FIG. 10 is a fragmentary cross sectional view taken on the line 10—10 of FIG. 9.
FIG. 11 is a fragmentary cross sectional view taken on the line 11—11 of FIG. 9.
FIG. 12 is a fragmentary elevational view, partly in section, taken on the line 12—12 of FIG. 9.
FIG. 13 is a fragmentary cross sectional view taken on the line 13—13 of FIG. 2A to an enlarged scale.
FIG. 14 is a fragmentary cross sectional view taken on the line 14—14 of FIG. 2A to an enlarged scale.
Figures 4, 5, 6, 7, 8:
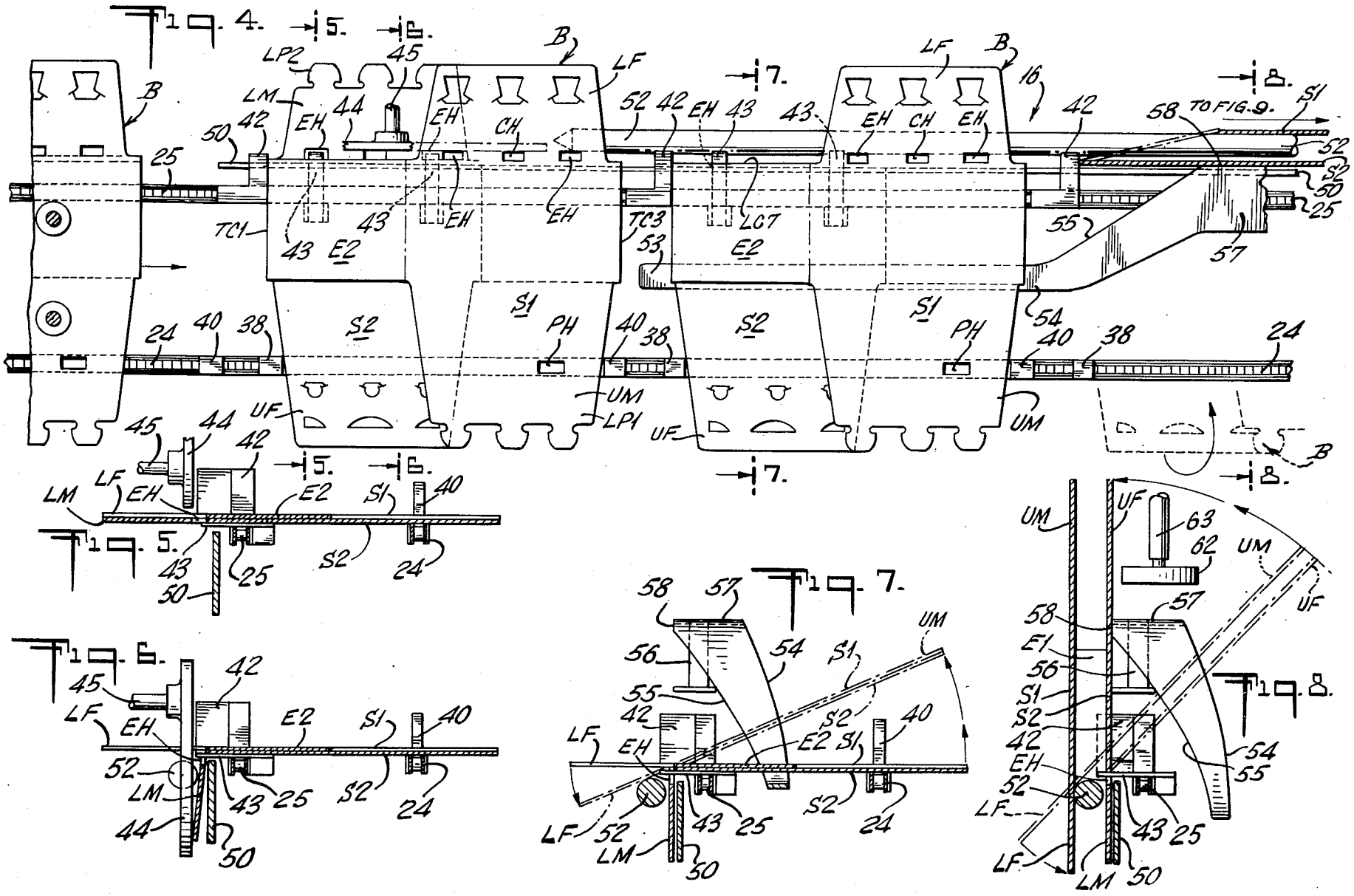
Figures 9, 10, 11, 12:
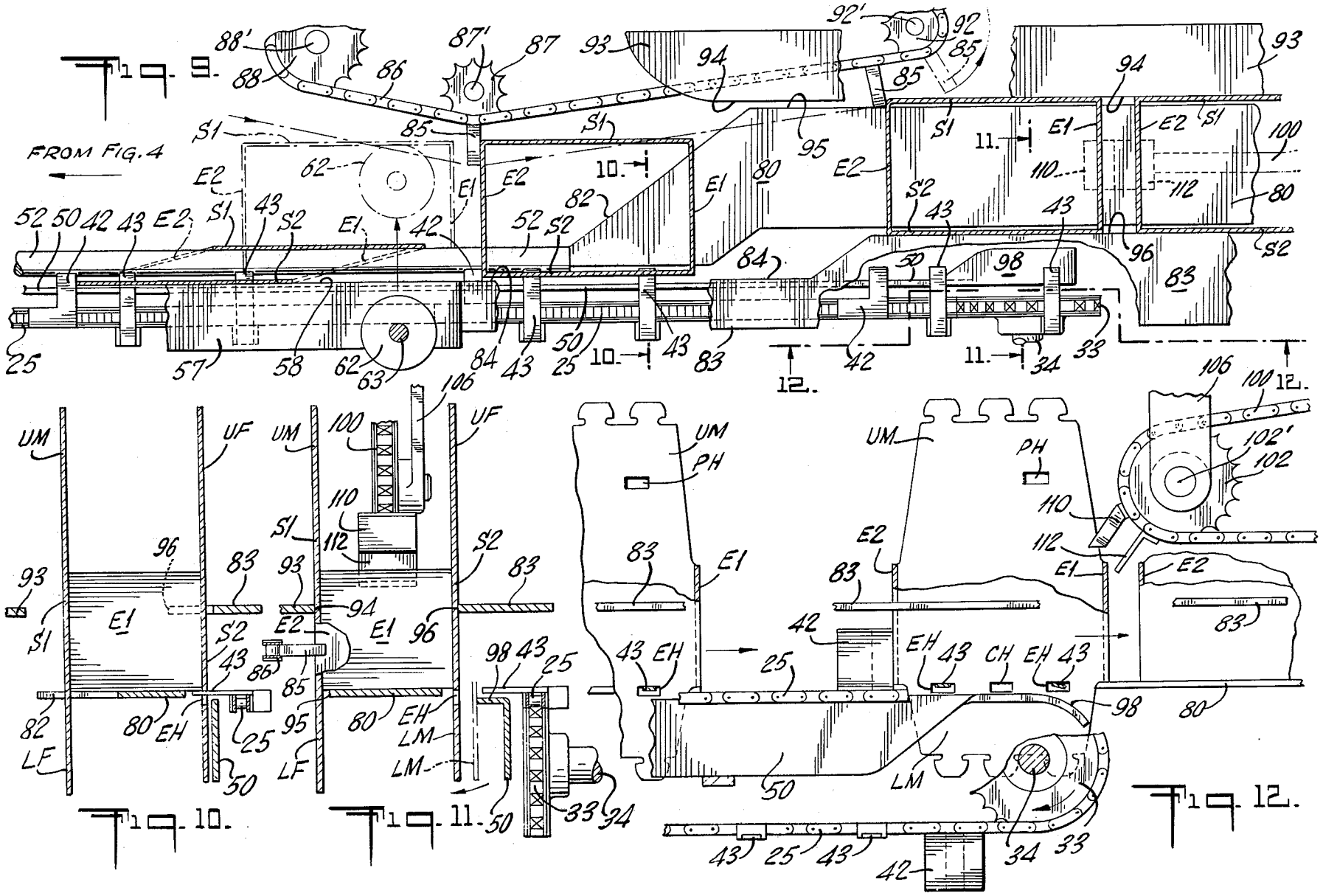
Figure 13:
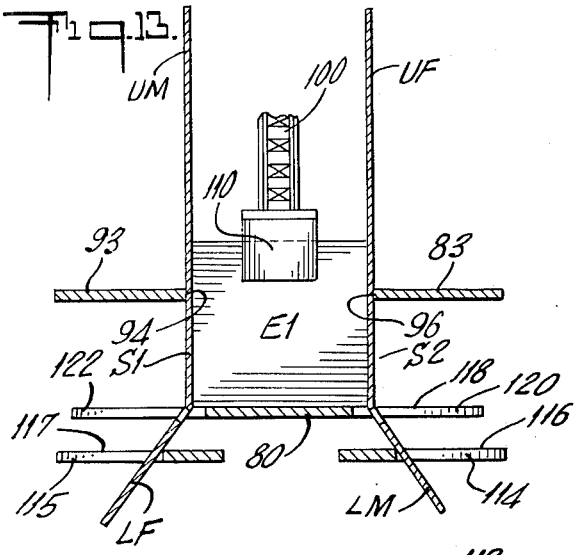
Figure 14:
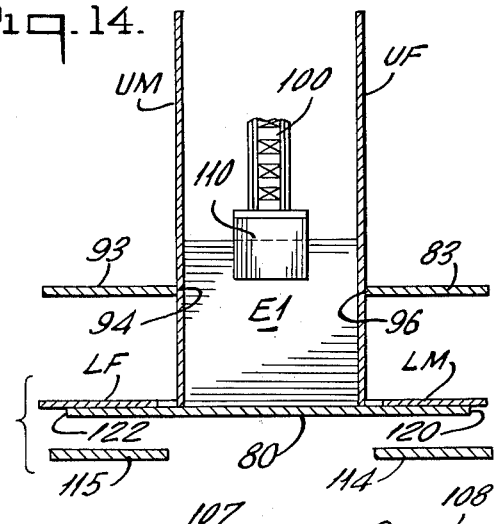
Figure 30:
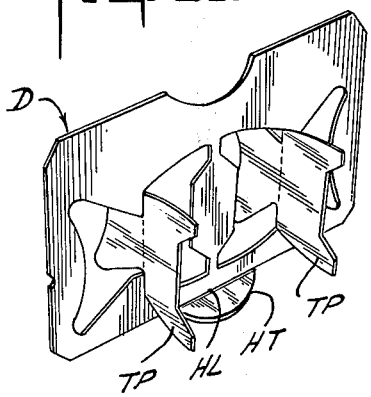
FIG. 30 is a perspective view of the longitudinal and transverse partition element for separating the bottles in the package.
Figure 31:
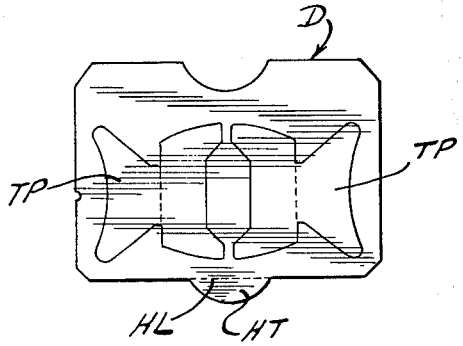
FIG. 31 is a plan view of the blank which is cut and scored to form the partition elements of FIG. 30.

The carrier or carton is fabricated at the manufacturing plant, for delivery to the bottling plant, in collapsed condition by folding blank B on the score or crease lines TC1 and TC3, with the panel section S1 and E2 being connected by the glue tab or glue panel G at the one end of the blank, the collapsed container carton being illustrated in FIG. 4, where successive collapsed carton units are shown deposited on an advancing conveyor at the infeed end of the machine. The bottle separator or partition forming panel structure D may be formed in accordance with the disclosure in Ser. No. 368,825. In the form illustrated in FIGS. 30 and 31, it comprises a generally rectangular, elongated panel, the main portion of which is designed to form a longitudinal partition between the two rows of bottles C in finished package P. It is provided with two spaced, transverse partition forming panels TP, which are cut so that they are adapted to hinge into transverse planes on spaced transverse score lines in order to form transverse partitions for separating the center bottles in the two rows from the end bottles therein. In addition, the separating panel D has a tab HT along the bottom forming edge thereof which is adapted to be bent over into a horizontal, transverse plane on a hinge forming crease or score line HL which is aligned with the edge of the panel. The tab HT is disposed in the final package P beneath the center bottle C which serves to hold the partition panel D in proper vertical position between the bottles, the height of the panel being substantially less than the height of the bottles, the tab HT serving to anchor the panel in its bottle separating position.

Referring to FIGS. 1A to 2C, particularly, there is illustrated a machine embodying the principles of the present invention which is adapted to form the package shown in FIG. 28 by enclosing a group of six bottles C arranged in double row, transversely aligned pairs, in a carton formed from the blank B. The blanks B are fed onto a conveyor at the infeed end of the machine in collapsed condition and opened into squared-up or tubular condition, with top and bottom wall forming panels extended in the planes of the side walls to which they are hinged. The squared-up cartons are advanced to a point where each successive carton is dropped onto an assembly of bottles advanced on a conveyor beneath the carton feed conveyor. Thereafter, the assemblies are advanced through mechanism for closing and latching the top and bottom wall forming panels with the partition forming member D being dropped between the bottle assemblies before they reach the point where the carton is lowered onto the same.

As illustrated in FIGS. 1A and 1B, the machine comprises an infeed section 10 at the entrance end thereof which includes an upper conveyor mechanism 12 on which the collapsed cartons are received and a lower bottle feed line conveyor mechanism 14 for advancing the bottles C in a double line beneath the carton feeding and set-up mechanism. The cartons are advanced through a carton opening or setting-up mechanism 16 where the collapsed cartons are opened onto tubular form and turned through 90° so as to place them in vertical position for further advance to a carton deposit or carton and bottle assembly station or section 18. Mechanism is provided at section 18 for carrying successive opened cartons down an inclined path and for lowering them onto successive groups of two rows of three bottles each, which are aligned transversely in pairs and which are advancing on the conveyor mechanism 14 beneath the carton advancing conveyor mechanism 12. A suitable mechanism (not shown) is provided for inserting a partition member D between the bottles of each group at some point prior to advance of the groups of bottles to the carton assembly station 18. Following the deposit of the cartons onto the bottle assemblies, mechanism is provided for advancing the carton and bottle assemblies through a mechanism 20 which is positioned to close the top and bottom wall panels and lock the same, as indicated in FIG. 1B. A package discharge conveyor 22 at the discharge or exit end of the machine is provided to receive the completed packages and deliver them out of the machine.

It will be understood that in the drawings illustrating the preferred form of the machine, the structural frame on which the various elements are mounted has been omitted or broken away, only parts being shown where it is considered to be helpful in understanding the arrangement of the machine elements and the operation thereof. Also, there are moving elements employed in the machine requiring connection to a suitable power drive means which drive means does not appear to require detailed illustration.

The infeed mechanism 12 for the collapsed cartons comprises a pair of longitudinally extending, laterally spaced, endless conveyor chains 24 and 25, the top runs of which travel in parallel paths and in a common place so as to support the collapsed cartons which are received thereon as shown in FIG. 4. Chain 24 is shorter than the chain 25 and is mounted on leading and trailing sprocket members 26 and 27 which are supported on parallel, longitudinally spaced, transverse shafts 28 and 30. The chain 25 is mounted at the trailing, or entrance end, on a sprocket 32 which is supported on cross shaft 28 in axially spaced relation to the sprocket 26 carrying the chain 24. At the leading end, the chain 25 is mounted on sprocket 33 which is supported on a driven cross shaft 34. The shaft 34 has an end sprocket 35 with chain 26 connected to a suitable power drive (not shown). The shafts 28, 30 and 34 are journaled in frame members one of which is shown at 37 in FIG. 2A. The chain 24 is supplied with longitudinally spaced, carton engaging lugs or pushers 38 which are spaced, lengthwise of the chain, to engage the trailing edges of the carton side wall panels S2. The chain 24 also carries carton positioning lugs or fingers 40 which are spaced relative to the pusher lugs 38 so as to form a carton positioning means which is engaged by the front or leading edge of the side wall panel S1 when the collapsed cartons are fed onto the conveyor mechanism. The distance between the pusher lugs 38 and positioning fingers 40 is slightly greater than the dimension of the flattened or collapsed carton along the line overlying the chain 24. The chain 25 extends in parallel, transversely spaced relation with the chain 24 and is supported on the trailing and leading sprockets 32 and 33 so that the top run thereof co-operates with the top run of the chain 24 in supporting the collapsed cartons thereon. The chain 25 is provided with pusher lugs or arm 42 which are spaced along the length of the chain 25 a sufficient distance to accommodate the cartons between the same. Each pusher arm 42 is angular in form with the one arm or leg thereof extending outboard of the conveyor chain 25 and each of the pusher arms 42 is positioned, or spaced lengthwise, on the chain 25 so as to co-operate with a pusher lug 40 on the chain 24 in holding the collapsed carton in proper position transversely of the two conveyor chains 24 and 25, with the drive for the chains 24 and 25 being properly synchronized. The one arm of the pusher lug 42 extends outboard of the chain 25 and each of the lugs engages the trailing edge of the collapsed carton at a point at the bottom of the score line LC1. The chain 25 also has mounted thereon a pair of finger members 43 in the form of relatively thin, rectangular plates which extend outboard of the chain 25 as shown in FIGS. 4 to 12 and which are spaced in advance of each of the pusher lugs 42 and longitudinally of the chain 25 so as to underlie the carton, when it is placed thereon, and position the outer ends thereof in alignment with the end heel holes EH in the carton panel LM.

At the entrance end of the conveyor chains 24 and 25 where the collapsed cartons are initially positioned there is mounted a bottom panel knockdown disc 44 (FIGS. 1A, 2A and 4 to 6) on a cross shaft 45 which is positioned above the top runs of the chains 24 and 25. The cross shaft 45 is suitably supported on a bracket 46 extending from a frame side plate 47. Shaft 45 is driven by a suitable power source (not shown) through a sprocket and chain drive connection 48. The knockdown disc or kicker member 44 is positioned and rotated in timed relation to the advance of the cartons on chains 24 and 25 so as to pass the topmost bottom wall forming panel LF and strike the lowermost wall panel LM which folds the latter downwardly into a vertical plane along the outside face of a longitudinally extending guide or guard plate 50 which is spaced outwardly of the path of chain 25 and parallels the same to a point near the cross shaft 34 at the leading end of the chain 25. As the panel LM is knocked down by the kicker disc or blade 44 the outermost ends of the finger plates 43 are positioned in the two end heel holes EH so as to maintain the carton in proper alignment on the conveyor 12 as it is advanced by the conveyor. The turned down bottom wall forming panel LM moves into a guide channel which is formed between the longitudinal guide plate 50 and a longitudinally extending guide rod or bar member 52, the latter being spaced in parallel relation outboard of the guide plate 50.

The collapsed carton is advanced in the flattened or collapsed state to the unfolding or set up station or area 16 (FIGS. 1A, 2A, 4, 7 and 8) near the leading end of the shorter chain 24, where the collapsed carton advances over the end portion 53 of a plow member 54 which plow end portion 53 extends between the chains 24 and 25. The plow 54 has an upwardly and outwardly curved edge 55 on which the collapsed carton body rides so that it swings or pivots about the hinge connection between the panel LM and the side wall panel S2 as illustrated in FIGS. 7 and 8. As the carton rides up on the plow 54 it is advanced by and its advance is controlled by the fingers 43 which extend into the heel hole apertures EH in the panel LM with a portion of the trailing pusher arm 42 still engaged with the trailing edge of the side wall panel E2 as shown in FIGS. 7 and 8. The uppermost bottom wall forming panel LF remains above the guide bar 52 as the carton rides up on the plow 54 and it begins to open as shown in FIG. 8 with the guide bar 52 separating the panels LM and LF. The plow 54 is supported on a suitable bracket 56 as shown in FIG. 8 and includes a horizontally disposed top portion 57 having an outer edge 58 extending parallel to the path of the chain 25 and spaced outwardly thereof so as to engage and guide the carton panel section S2.

When the carton reaches the top portion 57 of the plow 54 it is raised into a vertical plane, as shown in solid lines in FIGS. 8, and advances in a path which brings the top wall forming panels UF and UM opposite a small roller 62 (FIGS. 1A, 2A, 3, 8 and 9) on the bottom end of a shaft 63 which depends from a block connection on the outer end of a horizontally disposed slide rod 64. The slide rod 64 is mounted for horizontal movement in an upstanding bracket arm 65. A small bar 66 connects the slide rod 64 with a parallel slide rod 67 which is also mounted for horizontal sliding movement in the upper end of the standing bracket post 65. A link bar 68 is pivotally connected, at one end, to the end of the slide rod connecting bar 66 and, at the other end, to the upper end of a vertically disposed operating link 70 which is pivoted at 72 on the supporting post 65 and pivotally connected, at its opposite end, to a horizontally disposed link 73 which has a pivotal, off-center connection at 74 to a sprocket 75. The sprocket 75 is mounted on a suitably supported shaft 76 and driven by a chain 77 from a suitable drive source. The drive linkage provides for horizontal reciprocation of the roller 62 which is timed relative to the advance of the cartons to pass the upstanding wall forming panel UF and strike the panel UM so as to move the latter with its connecting panels LF and S1 outwardly of the panels UF, S2 and LM and to open up the carton into the tubular form, as illustrated in FIGS. 9 and 10. At this point the carton is still being advanced by the plate-like fingers 43, the ends of which extend into the heel holes EH. The side wall section S2 is restrained against lateral movement by the associated panel LM which is trapped in the channel between the guide plate 50 and the guide bar 52. The carton is opened by movement of the roller 62 against the upstanding panel UM as it is advanced by engagement with the fingers 43 on the chain 24 and moves onto a bottom support plate 80 which is disposed in a horizontal plane and extends from the end of the guide rod 52 along the side of the chain 25. An outwardly slanted edge 82 at the entrance end of the plate 80 serves to help square up the carton by engaging in plow-like fashion with the depending panel LF. The panel section 52 is held in line by a plate 83 which extends in a horizontal plane above the chain 25 with its outer edge 84 engaging the panel S2. The support plate 80 is offset laterally of the chain 25 so that, as the carton moves onto the plate 80, it is moved laterally away from the chain 25 which releases the successive cartons for advancing movement by pusher lugs or fingers 85 which are carried in longitudinally spaced relation on a traveling conveyor chain 86 (FIGS. 2A and 9). The chain 86 is supported for movement in a horizontal plane and laterally of the path of the cartons on the sprockets 87, 88, 90 and 92 which are arranged in spaced relation as shown in FIG. 2A. The sprockets 87, 88, 90 and 92 are supported on vertically disposed, parallel, shafts 87', 88', 90' and 92' which are journaled in portions of the frame (not shown). The chain 86 is suitably driven in proper timed relation with the chain 25 for advancing movement of the cartons as the advance of the cartons is taken over by the pusher lugs 85. The opening of the cartons results in increased spacing as shown in FIG. 9 and this spacing is subsequently adjusted as required for deposit on the bottle assemblies.

As the carton is advanced on the support plate 80 by the pushers 85 the outermost side wall section S1 and its associated top wall panel UM is guided by an outside guide plate 93 (FIGS. 2A, 9, 10 and 11) which has an inner edge 94 extending parallel with an outer edge 95 of the support plate 80 and disposed in a horizontal plane above the plane of the plate 80. On the other side of the path of advance of the carton the outermost edge 96 of the horizontally disposed guide plate 83 engages with and serves as a guide for the side wall panel section S2. The guide plates 83 and 93 are in a common horizontal plane. As shown in FIGS. 10 and 11, the carton top wall forming panels UF and UM extend above the body of the carton in the plane of the side wall forming panels S2 and S1 while the bottom wall forming panels LM and LF extend in the plane of the side walls S2 and S1 below the support plate 80. To insure that the cartons do not remain engaged with fingers as the cartons reach the end of the chain 25 the vertical guard plate 50 is provided with a horizontal outwardly directed flange 98 on the end portion (FIGS. 2A, 9, 11 and 12), the outer edge of which engages the panel LM and forces it outwardly so as to free it from the fingers 43 and permit the latter to move around the sprocket 33 for the return run of the chain 25 without damage to the cartons.

Figure 15:
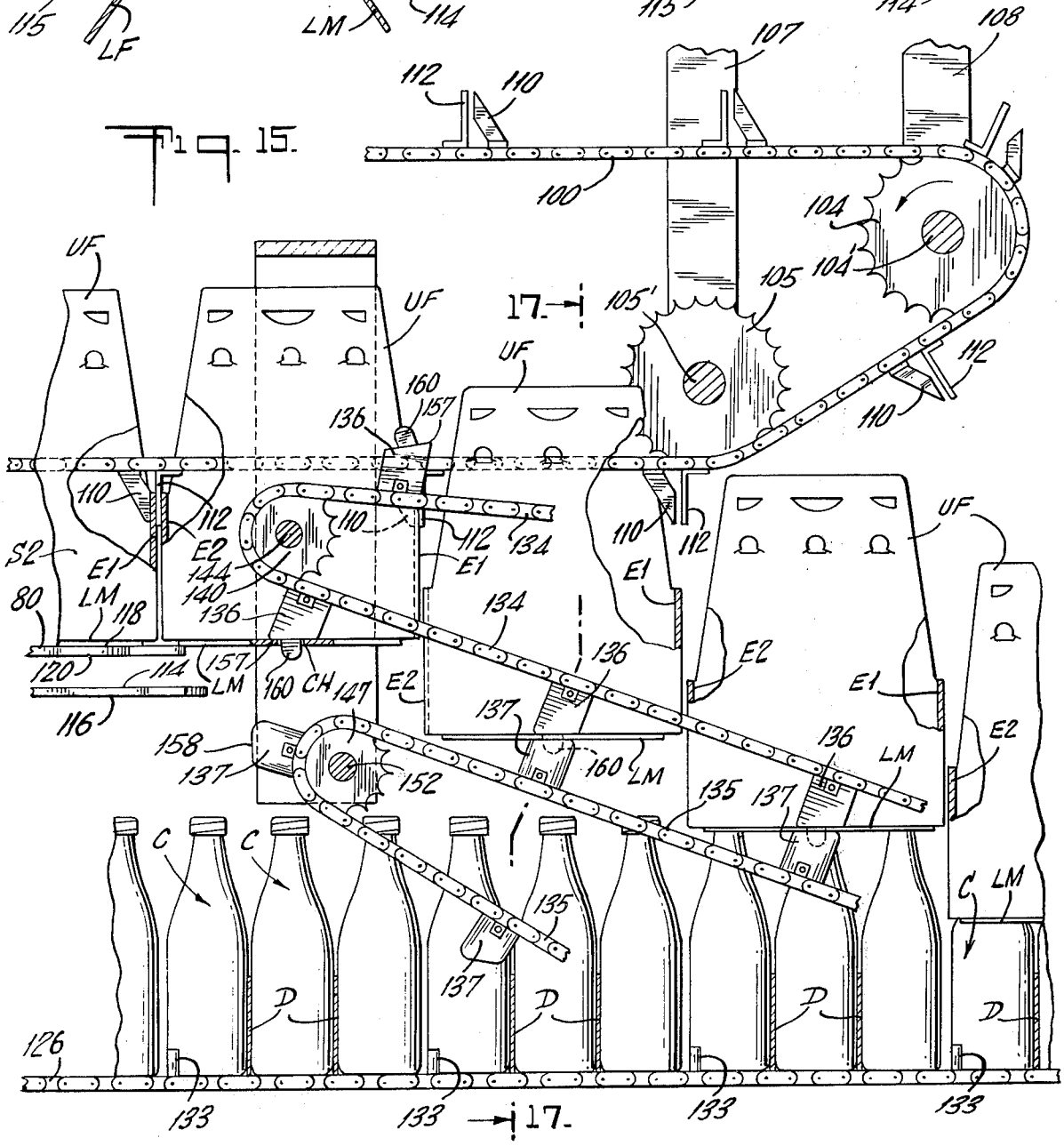
FIG. 15 is a fragmentary side elevational view to an enlarged scale and with portions broken away, the view showing the control of the advance of the cartons as they are deposited on the bottle assembles at the carton and bottle assembly station.

When the cartons reach the end of the chain 25 advancing movement is taken over by a conveyor forming chain 100 (FIGS. 1A, 2A and 12 to 15) which is mounted above the path of the cartons on sprockets 102, 103, 104 and 105. The sprockets are carried on parallel cross shafts 102', 103', 104' and 105' which are supported on depending frame members 106, 107 and 108. The chain 100 travels in a vertical plane extending above the path of advance of the cartons and carries, at longitudinally spaced intervals thereon, pairs of co-operating panel gripping or clamping members 110 and 112, which are so mounted on the chain 100 that they open up when they round the trailing sprocket 102, as shown in FIGS. 1A and 12. The movement of the chain 100 is timed relative to the advancing movement of the cartons, by the lugs 85 on the chain 86, so that, the top margin of the leading end wall panel E1 of each successive carton advances between the two open clamp members 110 and 112 as the latter round the sprocket 102. The clamp member 110 and 112 close on and grip the leading panel E1 while advancing the carton as it is supported on the bottom plate 80. The carton engaging clamp members or jaws 110 and 112 are spaced on the chain 100 and the movement of the latter is adjusted in timed relation to the advance of the cartons by the chain 25 so as to adjust the spacing between the cartons as they move along the plate 80 to the spacing required for subsequent deposit on the bottle assemblies. As each carton is advanced by the chain 100 it is supported on the plate 80 and confined between the vertically disposed edges 94 and 96 of the guide plates 93 and 83 with the bottom wall forming panels LF and LM in depending relation (FIG. 11). When the carton is advanced beyond the leading end of the chain 25, the bottom wall forming panels LF and LM are plowed or swung outwardly of the bottom edges of the side wall panels S1 and S2 by a pair of plow forming plate or bar members 114 and 115 which are suspended in a horizontal plane beneath the plate 80 and which have outwardly diverging outer edges 116 and 117 engaging the panels LF and LM and swinging them upwardly so as to move them into a horizontal position on a widened end portion 118 of the support plate 80, the latter having diverging edges 120 and 122 which co-operate with the members 114 and 115 in turning the panels LF and LM into the horizontal position as shown in FIG. 14. The successive cartons are spaced relatively close together as shown in FIG. 15 so as to align the same vertically with the groups of bottles which are advanced beneath the same by the bottle feeding mechanism 14.

Figure 18:
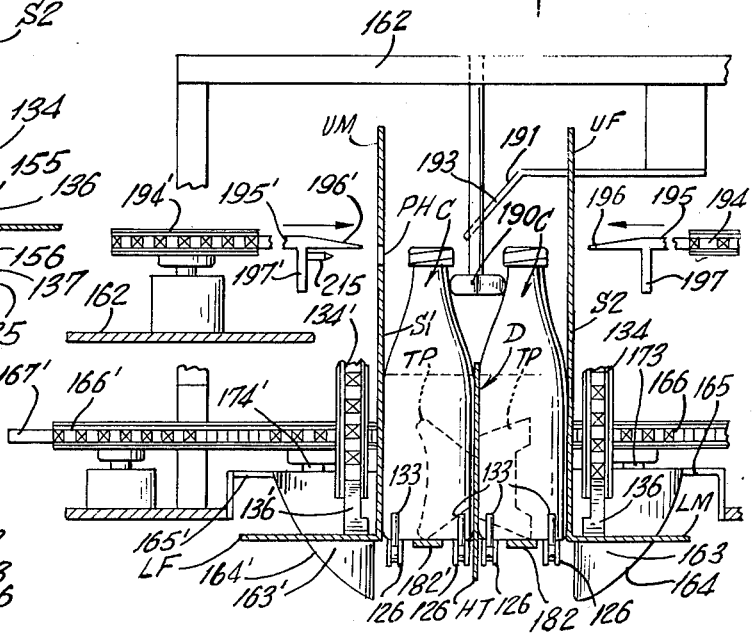
FIG. 18 is a fragmentary cross sectional view taken on the line 18—18 of FIG. 16.

As shown in FIGS. 1A and 2B a double row of bottles C is advanced on the bottle infeed conveyor 123, the leading end of which is shown supported on a sprocket 124, the latter being suitably mounted on a cross shaft 125 so that the upper run of the conveyor 123 supports the double row of bottles for travel, or advance, in a plane spaced below the path of advance of the carton carrying chains 24 and 25. The bottles are advanced by the infeed conveyor 123 is grouping conveyor 126 which is supported on leading end sprocket 127 (FIG. 1B) and trailing end sprocket 128 (FIG. 1A) with the sprockets 127 and 128 being mounted on cross shafts 130 and 132 suitably mounted on the support frame of the machine. The conveyor 126 is driven so that it is traveling at a slightly faster speed that the infeed conveyor 123 and carries grouping lugs or fingers 133 spaced along the length thereof so as to pick up successive groups of six of the bottles C and advance the same to the carton deposit or carton and bottle assembly section 18, where successive open cartons are lowered onto the groups of bottles while they are advancing on the conveyor 126. The conveyor 126 comprises a plurality of laterally spaced chain members. As shown in FIG. 18 there are two chains for each line of bottles with associated pusher lugs 133 also in pairs.

Figure 16:
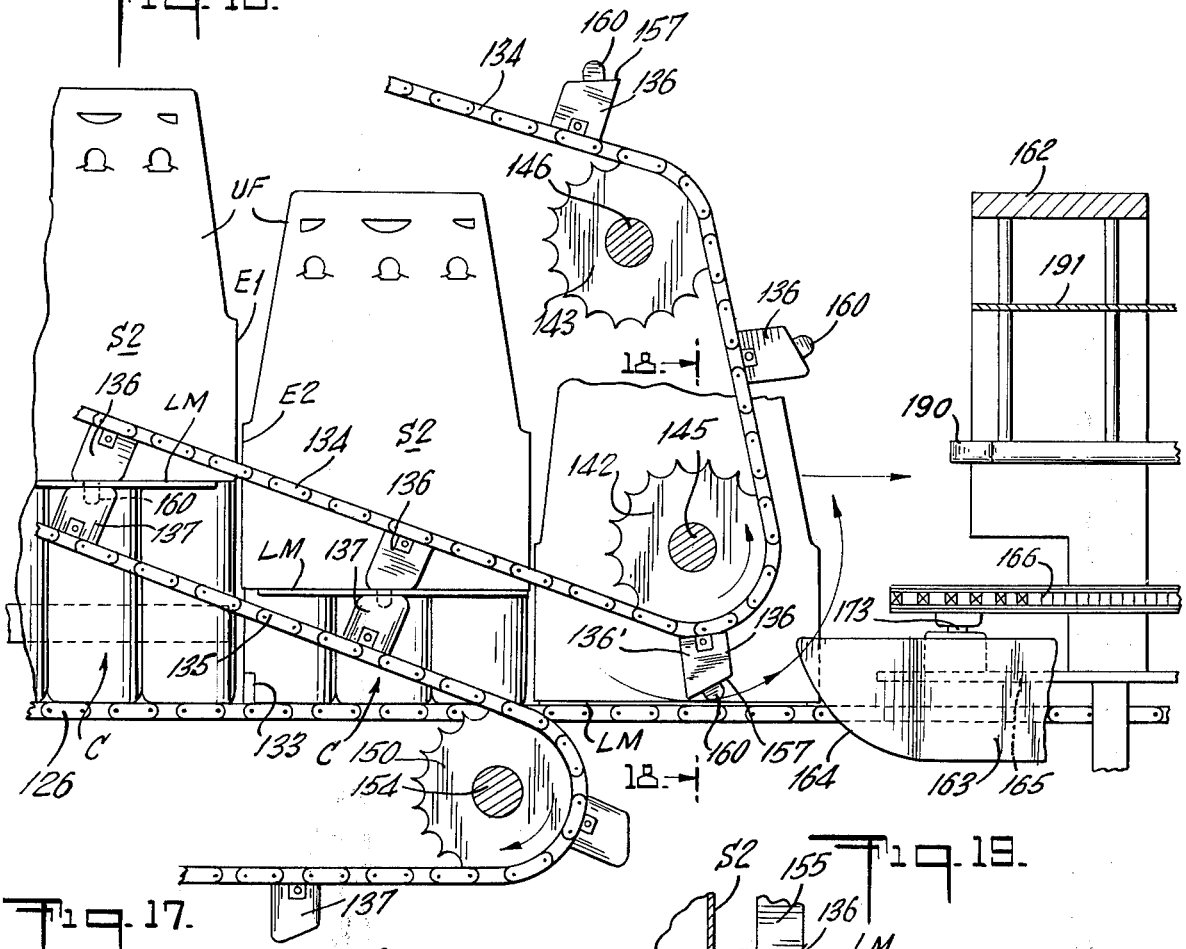
FIG. 16 is a fragmentary side elevational view, with portions broken away and to an enlarged scale, the view showing the advance of the cartons as they are brought down onto the bottle assemblies.
Figure 17:
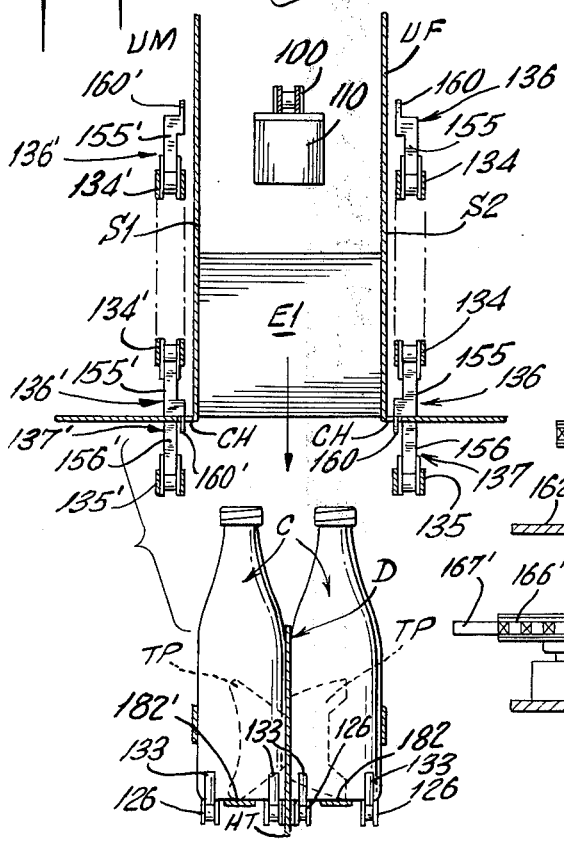
FIG. 17 is a fragmentary cross sectional view taken on the line 17—17 of FIG. 15.
Figure 19:
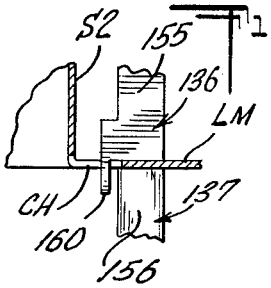
FIG. 19 is a fragmentary cross sectional view, to a greatly enlarged scale, the view showing a small portion of the mechanism shown in FIG. 17.

The cartons are dropped or carried down an incline at the leading station 18 (FIG. 1A, 1B, 2B and 15 to 17) by pairs of upper and lower endless chain conveyor mechanisms 134, 135 and 134′, 135′ arranged on each side of the upper and lower conveyors 100 and 126, the latter advancing the cartons and the bottle assemblies, respectively. The chain conveyors 134, 135 and 134′, 135′ are of identical construction except for being on opposite sides of the carton path. Each pair thereof has mounted thereon co-operating carton panel gripping or engaging members 136, 137 and 136′, 137′ respectively. The upper conveyor chains 134, 134′ are mounted on pairs of sprockets 140, 142 and 143 which are axially spaced on parallel cross shafts 144, 145 and 146 which are suitably supported on the machine frame. The shafts 144, 145 and 146 are arranged so that the lowermost runs of the chains 134 are in a downwardly inclined plane parallel with and spaced above corresponding upper runs of the lower chains 135, 135′. The lower chain assemblies 135, 135′ are supported on pairs of sprocket members 147, 148 and 150 which are axially spaced on parallel cross shafts 152, 153 and 154, the cross shafts being arranged so that the uppermost runs of the chains 135, 135′ are in oppositely disposed spaced relation to the inclined lower run of the chains 134. The panel gripping members 136, 137 and 136′, 137′ are in the form of co-operating clamps comprising mounting blocks or plates 155, 156 and 155′, 156′ (FIGS. 17 and 19), the end surfaces 157 and 158 (FIG. 16) of which are inclined relative to a plane normal to the plane of the associated support chain and which are complementary so as to engage on top and bottom surfaces of the carton bottom wall panels LM and LF as shown in FIGS. 16, 17 and 19 when the clamp members 136, 137 and 136′, 137′ are traveling along the parallel lower and upper runs of the chains 134, 134′ and 135, 135′ as shown in FIGS. 15 and 16. The clamp members 136, 136′ on the upper chains 134, 134′ each have a finger 160, 160′ which is offset inwardly of and extends beyond the end of the associated mounting block so as to engage the center heel hole CH in the panels LM and LF as shown in FIGS. 16 to 19 thereby insuring proper alignment of the cartons with the bottle assemblies as the cartons are advanced and lowered onto the same.

As the cartons reach the bottom of the inclined path and are fully seated on the bottle assembly the chains 134, 134′ and 135, 135′ move around the bottom sprockets 142 and 150, respectively, which separates the clamp members 136, 137 and 136′, 137′ and frees the outturned panels of the cartons. The cartons and bottle assemblies continue their advance on the conveyor 126 which extends beneath a cross frame 162 of inverted U shape.

Figure 20:
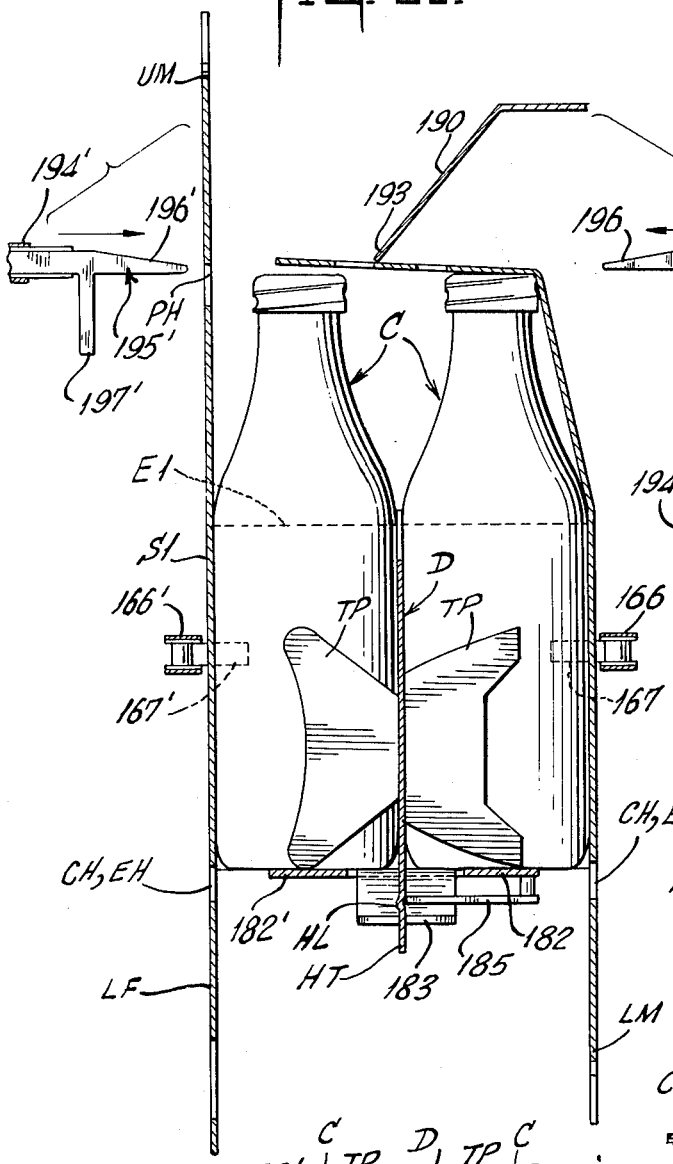
FIG. 20 is a cross sectional view taken on the line 20—20 of FIG. 2B, to an enlarged scale.

Plow members 163 and 163′ (FIGS. 1B, 2B, 2C, 16 and 18), in the form of plates, with curved entrance edges 164 and 164′ are mounted on the cross frame 162 at the bottom thereof which are in the path of the bottom wall forming panels LM and LF so as to turn these panels downwardly into vertical planes below the associated side wall panels S2 and S1 as shown in FIG. 20. The plow members 163 and 163′ are supported by means of laterally extending brackets 165 and 165′ on the cross frame 162.

Figure 22:
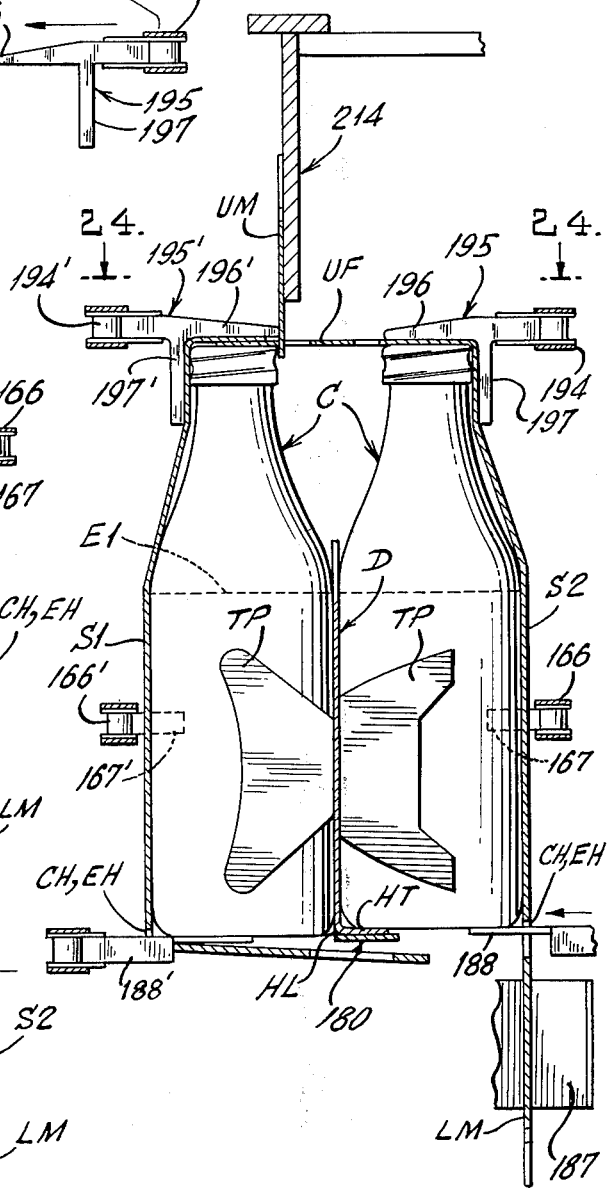
FIG. 22 is a cross sectional view taken on the line 22—22 of FIG. 2B, to an enlarged scale.
Figure 21:
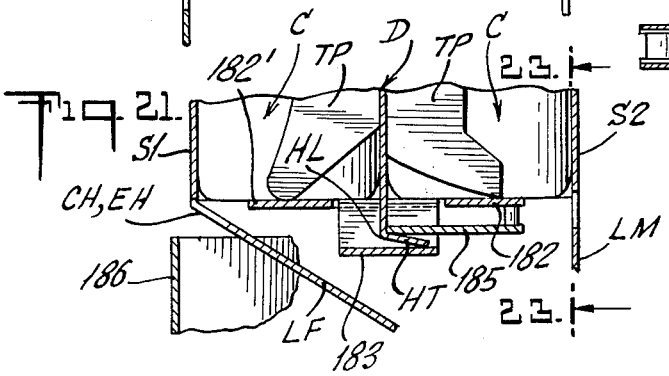
FIG. 21 is a fragmentary cross sectional view taken on the line 21—21 of FIG. 2B, to an enlarged scale.
Figure 23:
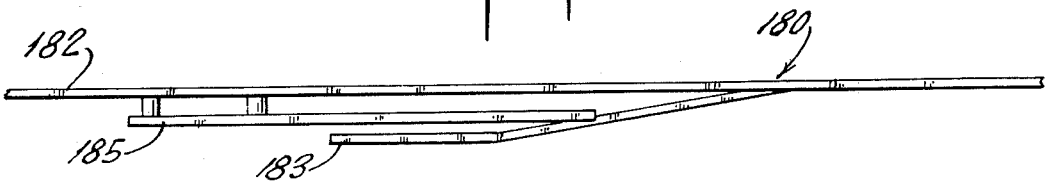
FIG. 23 is a fragmentary elevational view taken on the line 23—23 of FIG. 21.

The brackets 165 and 165′ (FIG. 18) are extended so as to support the entrance ends of laterally spaced conveyor chains 166 and 166′ which are mounted for movement in a common horizontal plane and which have lug members 167, 167′ spaced thereon for co-operation in advancing the carton and bottle assemblies along a path between transversely spaced, opposed runs of the chains 166, 166'. The conveyor chains 166 and 166' are supported in an identical manner on opposite sides of the carton path, as indicated in FIGS. 2B and 18. As shown in FIG. 2B the chain 166' is supported on four sprockets 168, 170, 172, 173, the sprockets being mounted on parallel, vertically disposed shafts 174, 175, 176, 177 with the shafts 174 and 173 at the entrance end thereof being supported on the bracket 165'. The chain 166 is supported in the same manner on the opposite side of the machine so as to provide parallel spaced runs between which the carton assembly is advanced. The chains 166, 166' are driven by connection with a suitable power drive (not shown). The chain conveyors 166, 166' take over the advance of the carton and bottle assemblies from the conveyor 126 which terminates at the cross frame 162. As the advance of successive carton and bottle assemblies is taken over by the side conveyors 166, 166' the assemblies are supported on a bottom plate 180 (FIG. 2B) which is bifurcated at the entrance end, providing clearance between laterally spaced legs 182, 182' (FIGS. 2B and 18) for travel of the center chains of the conveyor 126. A tongue member 183 (FIGS. 2B, 20 and 21) extends down between the legs 182 and 182' of the support plate 180 with a curved entrance edge 184 for engaging the holddown tab HT on the divider panel D which is positioned between the two rows of bottles and has settled to the bottom by gravity (FIG. 20). A horizontally disposed plate 185 is mounted in spaced relation beneath the one leg 182 of the support plate 180 with an inner edge positioned so as to strike the partition panel D on the hinge line HL and hold the body of the panel against bending while permitting the holddown tab HT to ride forward on the edge 184 of the tongue 183 so as to break the hinge crease and swing tab HT to the position shown in FIG. 21, with further forward movement of the assembly raising the panel D to its proper position, which is shown in FIG. 22, the lower edge of the panel D and the folded holddown tab HT riding up on the tongue 183 to a position on top of the support plate 180. During this movement the one bottom wall forming panel LF rides up on the top edge of a vertically disposed plow member 186 which is arranged beneath the support plate 180 to fold the panel LF into the horizontal position. Further advance of the carton and bottle assembly by the chains 166, 166' carries the same over a plow 187 arranged to engage the bottom wall panel LM and fold it into position for locking. The assembly advances between a pair of transversely spaced conveyors operating in a horizontal plane and carrying compression fingers 188, 188' (FIG. 22) which engage in apertures EH, CH and draw the bottom panels tight in the same manner as the compression fingers in U.S. Pat. No. 3,474,590 dated Oct. 28, 1969. Thereafter the assembly is advanced over a latching mechanism indicated at 189 which may be as shown in U.S. Pat. No. 2,986,857, dated June 6, 1961.

Mechanism for folding the top wall forming flaps or panels UF and UM and for tightening the same is illustrated in FIGS. 2C, 18 and 20 to 27. An elongate back up bar member 190 is suspended from the cross frame 162 so as to extend between the neck portions of the two rows of bottles C as they advance. A plow member 191 is mounted by means of a depending bracket 192 on the cross frame 162 with an inwardly tapered and downwardly turned edge 193 for folding down the male panel UF, the bottles being steadied by the back up bar 190. As the carton advances to bring the panel UF into contact with the folding blade edge 193 the assembly moves between a pair of laterally spaced chain assemblies 194 and 194' which are arranged for operation in a common horizontal plane with opposed runs between which the carton and bottle assemblies advance. The chains 194 and 194' have spaced along their length sets of outwardly directed finger members 195 and 195' which are arranged for co-operation in engaging and folding panel members UM and UF on opposite sides of the path of travel of the carton and bottle assemblies. The finger members 195 and 195' are of identical construction except as noted hereinafter. They are formed on flat plate material with horizontal and vertical legs 196, 196' and 197, 197' in right angle relation, the horizontal legs 196, 196' being tapered to a relatively thin end and being adapted to move in a horizontal path so as to strike the panels and fold them into top wall forming position (FIG. 22). The conveyor chain 194 is supported on a series of spaced sprockets 198, 200, 202, 203, 204 and 205 arranged as shown in FIG. 2C. The sprockets 198, 200, 202, 203, 204 and 205 are carried on parallel vertical shafts 206, 207, 208, 212 and 213. The chain 194' is supported in a like manner with the sprockets positioned so as to provide a funnel-like entrance between the two conveyors and opposed runs which are spaced a predetermined distance apart. The arrangement of the opposed chain runs and the spacing of the panel engaging members 195 and 195' is such that the latter co-operate in holding the panels UM and UF in tight top wall forming position as shown in FIG. 22 with the back up bar 190 separating the rows of bottles and holding them in line while the assemblies are advanced beneath a panel locking and latching mechanism indicated at 214. One of the finger members 195' of each group thereof is provided with a short pin 215 projecting from the vertical leg 197' which is adapted to engage in the hole PH of the panel S1 at the leading edge thereof so as to orient and square up the top of the carton.

The operation of the machine will be generally understood from the foregoing description of the machine details. The cartons in collapsed or flattened condition are fed from a magazine or other supply source to the top run of conveyor mechanism 12 (FIGS. 1A and 2A) where the panel LM is kicked down by rotating disc 44 and, as the carton advances, enters the vertical channel between guide plate 50 and guide bar 52 where it is confined while the body of the carton rides on the plow 54 to an upright position. At the opening station 16 the reciprocating roller 62 strikes the upstanding panel UM (FIG. 18) and opens the carton to tubular form whereupon the carton is shifted laterally by the support plate 80 and freed from the conveyor mechanism 12. The advance of the carton is taken over by the overhead conveyor 100 carrying clamp fingers 110, 112 which grip the leading end panel of the carton, the clamp members 110, 112 being spaced on the supporting chain to reduce the spacing of the carton which is increased when they are opened from the flat folded to the tubular condition and must be reduced to align with the bottle groups or assemblies delivered on the lower conveyor 126 to the assembly station or area 18. The conveyor 100 carries the opened cartons over plows 114, 115 which fold the bottom wall forming panels LM and LF outwardly in position to be gripped by co-operating clamp members 136, 137 and 136', 137' on the downwardly inclined chain members 134, 135 and 134′, 135′. The latter advance the cartons while lowering each successive carton onto an assembly of bottles, the carton and bottle assemblies being then advanced to the top and bottom wall panel closing and latching mechanisms disposed at 20, above and below the path of advance of the cartons. The bottom wall forming panels LM and LF are plowed to closed position, with provision, as shown in FIGS. 2B, 20, 21 and 22, for folding the hold down tab HT on an internal vertical bottle divider D and raising the divider panel and associated tab HT into proper position, by means of fixed blades 183, 185. The carton and bottle assemblies are advanced by the side chains 166, 166′ while top wall panel engaging and fold down members carried on traveling side chains position and hold the top wall panels for latching by overhead latching mechanism. Similar mechanism is provided beneath the path for latching the bottom wall forming panels which have been plowed to the closed position. The travel of the cartons is continuous from the entrance end to and through the final top and bottom panel closing mechanisms.

I claim:

1. An apparatus for opening and loading a folded tubular packaging container of the type which comprises a plurality of side wall panels connected on parallel hinge lines and having top and bottom wall forming closure panels extending in the plane of the side wall panels and hinged thereto, said container being adapted to be unfolded by hinging in opposite directions the side wall panels on hinge lines at opposite ends of the container, said apparatus comprising means for advancing successive folded containers in a generally horizontal plane and along a predetermined path with the hinge lines which connect the side wall panels extending transversely of the direction of travel, means forming a panel confining channel extending along one side of said container advancing means, means for turning a bottom wall forming panel on each successive container downwardly into a generally vertical plane and guiding the same into said panel confining channel, means for hinging said container about the panel which is confined in said channel so as to position said container in a generally vertical plane along said one side of said container advancing means with the unconfined panels free to pivot on said connecting hinge lines and to move a predetermined distance outwardly relative to said confined panel, means to move said unconfined panels outwardly thereby to open up said container into tubular condition, means to advance said opened up container to an assembly station, means to advance to said assembly station one or more articles to be loaded into said container and means to align the container vertically with said articles and to guide the container down onto the articles so as to load the container.

2. An apparatus as set forth in claim 1 wherein the means for advancing the containers comprises endless conveyor elements having container engaging pusher lugs spaced thereon and finger means for engaging with said bottom wall forming panel when it is disposed in said panel confining channel so as to advance said container when said container is hinged to a vertical position.

3. An apparatus set forth in claim 1 wherein the means for advancing the containers comprises a pair of endless chain conveyor members supported for travel in spaced parallel relation with top runs thereof in a common horizontal plane and having container engaging lugs carried thereon in spaced relation so as to position the containers for advance in uniform spaced relation.

4. An apparatus as set forth in claim 3 wherein one of said endless chain conveyor members has mounted thereon one or more finger members of plate-like form which are positioned to extend outboard of the chain so as to engage in an aperture in the bottom wall forming panel when it is disposed in said panel confining channel thereby serving to enable the chain member to advance to the container when it is hinged to a vertical position.

5. An apparatus as set forth in claim 1 wherein said means to hinge said container about the panel which is confined in said channel comprises a plow member positioned relative to said container advancing means to engage the leading edge of the container and providing an upwardly curved track forming edge for guiding the container to an upright position in a generally vertical plane.

6. An apparatus as set forth in claim 1 wherein said means to move said unconfined panels outwardly of said confined panel includes a roller member disposed above said container advancing means, a mounting means for supporting said roller for reciprocation in a path extending transversely of the path of said conveyor advancing means and means for reciprocating said roller in timed relation to the advance of the cartons so as to strike an upstanding unconfined panel of each successive carton and move the same outwardly thereby opening the carton.

7. An apparatus as set forth in claim 1 wherein said means to advance said opened up container to said assembly station comprises an endless conveyor member mounted for travel in a horizontal plane and spaced laterally of said container advancing means, which endless conveyor member has mounted thereon spaced pusher member for engaging the trailing side of each successive opened up container and for advancing the same, and a bottom supporting and panel guiding member disposed at the end of said container advancing means for moving the opened up container in a path which frees the container from said container advancing means at the leading end of said container advancing means.

8. An apparatus as set forth in claim 1 wherein said means to advance said articles to said assembly station comprises an endless conveyor aligned beneath said container advancing means and having a top run on which articles are supported in continuous row alignment and having spaced article engaging lugs for separating groups of articles of a predetermined number.

9. An apparatus as set forth in claim 1 wherein said means to align each said container comprises upper and lower endless conveyor members which are spaced laterally of the path of advance of the opened containers and having opposed runs with cooperating panel gripping members operative to grip outturned bottom wall forming panels on the successive containers which opposed runs are mounted to travel in a downwardly inclined plane so as to carry the successive containers down onto the articles at said assembly station.

10. An apparatus for opening a collapsed tubular container of the type which is characterized by a series of hingedly connected side and end wall forming panels adapted to collapse by folding into a common plane and to be opened by swinging the end wall forming panels at opposite ends about their connecting hinge folds, said container having top and bottom wall forming panels hingedly connected to oppositely disposed side wall panels which are in the plane of the associated side wall panels in the collapsed condition, said apparatus comprising conveyor means having a horizontally disposed run for receiving successive containers in collapsed condition and for advancing said containers along a predetermined path with the end hinge folds thereof extending transversely of the direction of travel, means forming a narrow guide channel in laterally spaced relation along one side of the path of said container conveyor means, means for engaging a lowermost bottom wall forming panel on each successive carton and for guiding it into said channel in a vertical extending position, means associated with said container advancing means for swinging each successive container about the hinge connection with the panel which is confined in said channel so as to bring the container into a vertical position, and means operative on an upstanding unconfined panel to cause the end wall panels to swing about the vertically disposed end fold lines and thereby open the container and position it in upright tubular form.

11. An apparatus as set forth in claim 10 wherein said means to cause the end wall panels to swing about said end fold lines comprises an elongate support plate which is offset laterally relative to said container conveyor means with side edges disposed to engage inside faces of depending bottom wall forming panels of said containers as the containers are advanced to the leading end of said container conveying means so as to guide the containers into a path of advance where they are free of said container conveyor means and means for engaging an upstanding top wall forming panel of each of said successive containers and for moving the associated wall forming panels outwardly of said panel which is confined in said channel so as to open the containers as they are advanced onto said support plate.

12. An apparatus as set forth in claim 10 wherein said means for engaging said lowermost bottom wall forming panel on each successive carton and for guiding it into said guide channel comprises a rotating blade member disposed above and to one side of said container conveyor means and adjacent the entrance to said guide channel.

13. An apparatus as set forth in claim 10 wherein said guide channel forming means comprises an elongate vertically disposed guide plate supported along the side of said container conveyor means and spaced a short distance outboard thereof with a top edge portion positioned beneath the hinge line connecting the bottommost carton bottom wall forming panel with the associated side wall forming panel when the collapsed carton is received on said conveyor means and a parallel bar member spaced a short distance outboard of said guide plate and extending in spaced relation along the top edge of said guide plate.

14. An apparatus for opening, filling and closing collapsed tubular containers of the type which comprise a series of hingedly connected side wall panels which are folded into a common plane and top and bottom wall forming panels which are in the plane of the associated side wall panels, and which are hinged to top and bottom forming edges of said side wall panels, said container being adapted to be opened by hinging the side wall panels at their opposite ends in opposite directions about hinge forming connecting folds, said apparatus comprising means for advancing successive collapsed containers along a generally horizontal path with said hinge forming folds extending transversely of the direction of travel, means forming a vertical channel along a side of the path of said container advancing means, means disposed along one side of the path of travel for folding a lowermost bottom wall forming panel of each successive container downwardly about its hinged connection with the associated side wall panel and guiding it into said vertical channel which is disposed along said one side of the path of said container advancing means, means for engaging said container and for turning the container upwardly about the hinged connection with the panel which is confined in said vertical channel so as to swing the container, while it is advancing, into a vertical position with the side wall panels extending above said vertical channel and certain of said panels being free to hinge about the vertically disposed connecting folds, panel guiding means operative to open the container into tubular form by hinging said free side wall forming panels about said connecting folds, conveyor means for advancing assemblies of articles in a path extending below the container opening means, means to align the containers with successive article assemblies, means moving with said containers for guiding the opened containers down an inclined path and depositing them on successive article assemblies, means for folding the bottom wall forming panels into bottom closing position and means traveling with said containers for folding the top wall forming panels onto top closing position.

15. An apparatus as set forth in claim 14 wherein said means for guiding said opened containers down an inclined path comprises upper and lower endless conveyor members mounted in paired relation on opposite sides of the path of advance of the containers and having opposed runs with means thereon for engaging bottom wall forming panels which are turned outwardly on each side of the containers.

16. An apparatus as set forth in claim 14 wherein said conveyor means for advancing assemblies of articles in a path below said container opening means comprises an endless conveyor mechanism having means for supporting a double line of articles in transversely aligned pairs which articles have the general form of bottles and means on said conveyor mechanism for segregating groups of the articles and advancing the groups to a position beneath said means for guiding the opened containers down said inclined path so as to enable the containers to be deposited on successive article assemblies.

17. An apparatus as set forth in claim 14 wherein said means for guiding the opened containers down an inclined path comprises pairs of endless traveling conveyor members arranged on each side of the path of advance of the containers, each pair thereof having opposed runs supported for travel in a downwardly inclined path and means on said conveyor members for gripping outwardly turned bottom wall forming panels of successive containers and advancing the same between said opposed conveyor runs.

18. An apparatus as set forth in claim 17 wherein said means on said conveyor members for gripping and panels comprises cooperating spaced lug members having complimentary end surfaces between which the container panels are received and a projecting finger on one of said lug members disposed for engagement in an aperture provided in said panels.

19. An apparatus as set forth in claim 14 wherein said means for folding the top wall forming panels into top closing position comprises a pair of horizontally disposed endless traveling conveyors mounted on opposite sides of the path of advance of said container and article assemblies with spaced parallel runs between which the container and article assemblies are advanced, and said traveling conveyors having mounted in spaced relation thereon and in outboard extending relation cooperating finger members which engage the upstanding top wall forming panels of each successive container and fold said panels downwardly in predetermined sequence onto the tops of said articles while advancing with said containers to a panel securing means.

20. An apparatus as set forth in claim 19 wherein said panel engaging finger members are in the form of angularly related plate members having leg portions disposed in horizontal and vertical planes so as to fold down the top wall forming panels and overlie portions of the hingedly connected side and top wall panels at the connecting hinge line thereby holding the top wall forming panels in proper position for securing them in tightly drawn relation on the top of the articles.

21. An apparatus as set forth in claim 19 wherein said panel engaging fingers have means thereon for engaging a portion of a side wall panel so as to orient and square up the top of the container as it is advancing.

22. An apparatus as set forth in claim 20 wherein at least one of said panel engaging finger members has a pin member projecting from the panel engaging face of a leg portion which is in a vertical plane and which pin member is positioned to engage in an aperture provided in the container side wall panel which the leg portion engages so as to orient and square up the top portion of the container as it is advancing.

23. An apparatus for opening collapsed cartons preparatory to filling the same, which cartons are formed of foldable sheet material with body forming side and end wall panels connected on parallel hinge lines and having top and bottom wall forming closure panels which are hingedly connected to top and bottom edges of the side wall panels and which extend in the plane of the associated side wall when in collapsed condition, said apparatus comprising a carton supporting conveyor having a horizontal disposed run on which successive collapsed cartons are positioned with the parallel hinge lines connecting the side and end wall panels extending transversely of the path of advance of said supporting conveyor, means for folding down along the side of the path of said supporting conveyor a bottom wall forming closure panel of each successive carton, means along the side of said conveyor means for retaining said folded down panels in a generally vertical plane while the cartons are advanced by said supporting conveyor to a carton opening area, means at said carton opening area for swinging the collapsed body forming panels of each successive carton upwardly about the hinged connection with said folded down closure panel so as to bring the carton into a generally vertical plane, and means for forcing the wall forming panels which are free of said folded down closure panel in a direction laterally of the path of said supporting conveyor so as to open said carton into tubular condition, thereby enabling the carton to be advanced to a filling station where it is adapted to be filled through the open bottom thereof.

* * * * *